US010146151B2

(12) United States Patent
Mizutani

(10) Patent No.: US 10,146,151 B2
(45) Date of Patent: Dec. 4, 2018

(54) OPTICAL SCANNING DEVICE AND IMAGE FORMING APPARATUS INCLUDING THE SAME

(71) Applicant: KYOCERA Document Solutions Inc., Osaka (JP)

(72) Inventor: Hideji Mizutani, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/846,623

(22) Filed: Dec. 19, 2017

(65) Prior Publication Data

US 2018/0181021 A1 Jun. 28, 2018

(30) Foreign Application Priority Data

Dec. 22, 2016 (JP) ..... 2016-248739

(51) Int. Cl.
*G03G 15/00* (2006.01)
*G03G 15/043* (2006.01)

(52) U.S. Cl.
CPC ..... *G03G 15/043* (2013.01); *G03G 15/5058* (2013.01)

(58) Field of Classification Search
CPC ..... G03G 15/043; G03G 15/5058
See application file for complete search history.

(56) References Cited

U.S. PATENT DOCUMENTS

2002/0113856 A1* 8/2002 Suzuki ..... H04N 1/4015 347/133
2004/0246545 A1* 12/2004 Touura ..... G03G 17/04 358/521
2009/0087207 A1* 4/2009 Iida ..... G03G 15/043 399/74
2009/0245831 A1* 10/2009 Nishikawa ..... G03G 15/043 399/51
2010/0329710 A1* 12/2010 Yamazaki ..... G03G 15/0131 399/49
2012/0099165 A1* 4/2012 Omori ..... H04N 1/0473 358/475
2012/0162670 A1* 6/2012 Ohnishi ..... G03G 15/0189 358/1.4
2013/0050388 A1* 2/2013 Ohnishi ..... H04N 1/00015 347/224

(Continued)

FOREIGN PATENT DOCUMENTS

JP 2004-106234 4/2004

*Primary Examiner* — David Bolduc
(74) *Attorney, Agent, or Firm* — Wenderoth, Lind & Ponack, L.L.P.

(57) ABSTRACT

In an optical scanning device, light emitting start timings of light emitting parts with respect to a reference light emitting part are stored in a storage part. In a correction mode, a light emitting timing correction control part performs first control for allowing positions of beam spots of the light beams emitted from the light emitting parts to be equal to each other, second control for allowing a light emitting part LD4 to emit a light beam at a plurality of different start timings and patch images to be formed on a intermediate transfer belt 281, and third control for correcting light emitting start timings of light emitting parts LD2 to LD4 on the basis of the start timing of the light emitting part LD4 at which the patch images has the highest concentration.

6 Claims, 11 Drawing Sheets

(56) References Cited

U.S. PATENT DOCUMENTS

| | | | | |
|---|---|---|---|---|
| 2013/0243446 | A1* | 9/2013 | Masuda | G03G 15/6558 399/16 |
| 2013/0286132 | A1* | 10/2013 | Yamazaki | G03G 15/043 347/118 |
| 2013/0302052 | A1* | 11/2013 | Iwata | G03G 13/04 399/49 |
| 2014/0036020 | A1* | 2/2014 | Ishihara | G03G 15/043 347/224 |
| 2014/0240431 | A1* | 8/2014 | Murayama | G03G 15/04054 347/118 |
| 2015/0212447 | A1* | 7/2015 | Yagi | G03G 15/043 347/118 |
| 2015/0248093 | A1* | 9/2015 | Ikeda | G03G 15/5025 399/49 |
| 2015/0277324 | A1* | 10/2015 | Goto | G03G 15/043 399/72 |
| 2015/0365554 | A1* | 12/2015 | Kawana | H04N 1/02885 358/474 |
| 2016/0370727 | A1* | 12/2016 | Nakajima | G03G 15/043 |
| 2017/0019561 | A1* | 1/2017 | Furuta | H04N 1/4052 |
| 2017/0038703 | A1* | 2/2017 | Horiuchi | G03G 15/043 |

* cited by examiner

Light emitting control signal of LD4

OPTICAL SCANNING DEVICE AND IMAGE FORMING APPARATUS INCLUDING THE SAME

CROSS-REFERENCE TO RELATED APPLICATION

This application is based upon and claims the benefit of priority from Japanese Patent Application No. 2016-248739 filed on Dec. 22, 2016, the entire contents of which are incorporated herein by reference.

BACKGROUND

The technology of the present disclosure relates to an optical scanning device that scans a peripheral surface of an image carrying member with light beams and an image forming apparatus including the same.

An image forming apparatus such as a laser printer and a copy machine includes an optical scanning device that performs scanning exposure of a peripheral surface of a photosensitive drum (an image carrying member) with light beams and forms an electrostatic latent image on the peripheral surface. For example, as an example of the optical scanning device, there has been known a multi-beam type optical scanning device. The multi-beam type optical scanning device includes a light source in which there are a plurality of light emitting parts (laser diodes) that emit light beams.

In the multi-beam type optical scanning device, each light emitting part of the light source normally has a main scanning pitch and a sub-scanning pitch and is arranged along a predetermined arrangement direction. Furthermore, in order to form an electrostatic latent image according to image data on a peripheral surface of a photosensitive drum, a light emitting start timing of each light emitting part is set in accordance with the main scanning pitch. A light beam is emitted from each light emitting part at a predetermined light emitting start timing. The emitted each light beam draws a main scanning line along a main scanning direction on the peripheral surface of the photosensitive drum in a state of keeping an interval in a sub-scanning direction in accordance with the sub-scanning pitch. In this way, the optical scanning device can form the electrostatic latent image according to the image data on the peripheral surface of the photosensitive drum.

SUMMARY

An optical scanning device according to one aspect of the present disclosure is installed at an image forming apparatus. The image forming apparatus includes an image carrying member having a peripheral surface carrying an electrostatic latent image and a developer image and a transfer body to which the developer image on the peripheral surface is transferred. The optical scanning device scans the peripheral surface with a light beam in a main scanning direction to form the electrostatic latent image on the peripheral surface. The optical scanning device includes a light source, a storage part, a control unit, and a concentration detection unit. In the light source, a plurality of light emitting parts for emitting light beams are arranged with a prescribed main scanning pitch in a predetermined arrangement direction. The storage part stores light emitting start timings of remaining light emitting parts, except for a reference light emitting part being one of the plurality of light emitting parts, with respect to the reference light emitting part, the light emitting start timings being set in accordance with the main scanning pitch. The control unit can perform a correction mode. The correction mode is a mode for correcting the light emitting start timings stored in the storage part. In the correction mode, in order to form a developer image with a specific pattern on the transfer body, an electrostatic latent image corresponding to the developer image with a specific pattern is formed on the peripheral surface. The concentration detection unit is arranged to face the transfer body and detects developer concentration of the developer image with a specific pattern formed on the transfer body.

In the correction mode, the control unit performs first control, second control, and third control.

The first control is control for allowing positions of beam spots of light beams, which are emitted from the reference light emitting part and one first remaining light emitting part of the remaining light emitting parts, on the peripheral surface to be equal to each other.

The second control is control for allowing the reference light emitting part to emit the light beam, allowing the first remaining light emitting part to emit the light beam at a plurality of different start timings on the basis of the light emitting start timing stored in the storage part and corresponding to the first remaining light emitting part, allowing an electrostatic latent image to be formed on the peripheral surface, and allowing the developer image with a specific pattern corresponding to the electrostatic latent image to be formed in different area parts on the transfer body in correspondence to the start timings.

The third control is control for recognizing a start timing of the first remaining light emitting part at which the developer concentration of the developer image with a specific pattern formed in the each area part on the transfer body is highest concentration, and correcting the light emitting start timings of the remaining light emitting parts in accordance with the main scanning pitch on the basis of the recognized start timing, the developer concentration being detected by the concentration detection unit.

An image forming apparatus according to another aspect of the present disclosure includes an image carrying member, the aforementioned optical scanning device that scans the peripheral surface of the image carrying member with the light beam and allows the electrostatic latent image to be carried on the peripheral surface, a development part that supplies a developer to the peripheral surface on which the electrostatic latent image is formed and allows the developer image to be carried on the peripheral surface, and a transfer body to which the developer image on the peripheral surface is transferred.

DETAILED DESCRIPTION

Hereinafter, an optical scanning device according to an example of an embodiment and an image forming apparatus will be described with reference to the drawings. Hereinafter, a directional relation will be described using a XYZ orthogonal coordinate axis. An X direction corresponds to a right and left direction (+X indicates right direction and −X indicates left direction), a Y direction corresponds to a front and rear direction (+Y indicates front direction and −Y indicates rear direction), and a Z direction corresponds to an up and down direction (+Z indicates up direction and −Z indicates down direction). In the following description, a term "sheet" represents a copy paper, a coated paper, an OHP sheet, a heavy sheet, a postal card, a tracing paper, another sheet material to be subjected to an image forming process, or a sheet material to be subjected to an arbitrary process other than the image forming process.

[Overall Configuration of Image Forming Apparatus]

Figure 1:
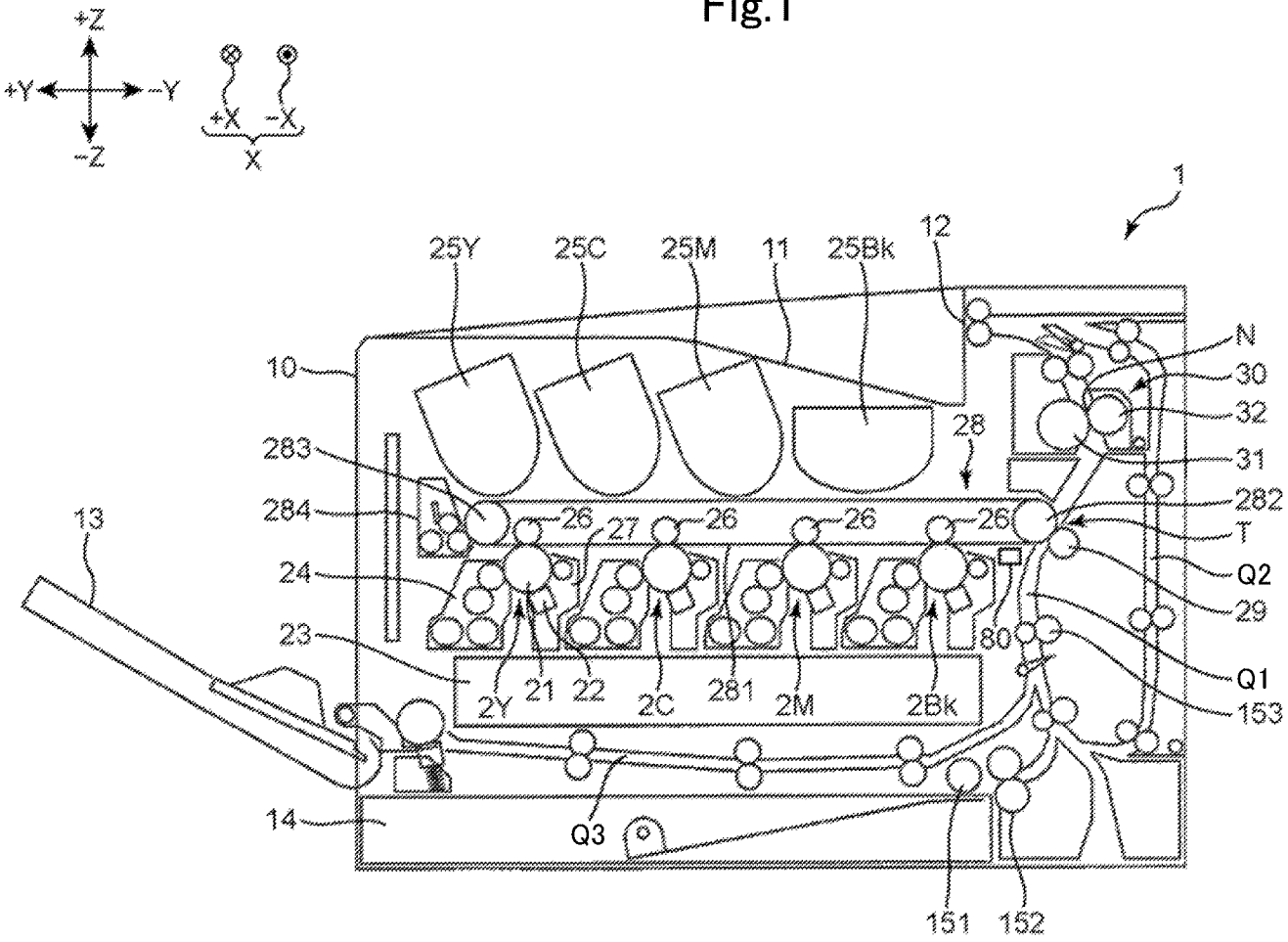
FIG. 1 is a diagram schematically illustrating an image forming apparatus including an optical scanning device according to an example of an embodiment.

FIG. 1 is a diagram schematically illustrating an image forming apparatus 1 including an optical scanning device 23 according to an example of an embodiment. The image forming apparatus 1 is a tandem type color printer and includes a body housing 10 including an approximately rectangular parallelepiped housing. The image forming apparatus 1 may be a full color copy machine and a multifunctional peripheral.

The body housing 10 ha a plurality of processing units for performing an image formation process on a sheet therein. In the present embodiment, the processing units include image formation units 2Y, 2C, 2M, and 2Bk, the optical scanning device 23, an intermediate transfer unit 28, and a fixing unit 30. The body housing 10 is provided at an upper surface thereof with a sheet discharge tray 11. A sheet discharge port is opened to face the sheet discharge tray 11. At a sidewall of the body housing 10, a manual feed tray 13 is mounted so as to be openable and closable. At a lower part of the body housing 10, a sheet feeding cassette 14 is detachably mounted to receive sheets to be subjected to the image formation process.

The image formation units 2Y, 2C, 2M, and 2Bk form developer images (toner images) of each color of yellow (Y), cyan (C), magenta (M), and black (Bk) on the basis of image data transmitted from an external device such as a computer. The image formation units 2Y, 2C, 2M, and 2Bk are randomly arranged at a predetermined interval in a horizontal Y direction (the front and rear direction). The image formation units 2Y, 2C, 2M, and 2Bk respectively include a photosensitive drum 21 (an image carrying member) including a cylindrical body carrying an electrostatic image and the developer image (the toner image) and extending in the X direction (the right and left direction), a charging device 22 for charging a peripheral surface (a drum peripheral surface) of the photosensitive drum 21, a development part 24 for forming the toner image by attaching a developer to the electrostatic image, toner containers 25Y, 25C, 25M, and 25Bk of yellow, cyan, magenta, and black for supplying toner of each color to the development parts 24, a primary transfer roller 26 for primarily transferring the toner image formed on the photosensitive drum 21, and a cleaning device 27 for removing remaining toner on the drum peripheral surface of the photosensitive drum 21.

In the following description, in the case of particularly describing the photosensitive drum 21 provided to each of the image formation units 2Y, 2C, 2M, and 2Bk, the photosensitive drum provided to the image formation unit 2Y is referred to as a "first photosensitive drum 21Y", the photosensitive drum provided to the image formation unit 2C is referred to as a "second photosensitive drum 21C", the photosensitive drum provided to the image formation unit 2M is referred to as a "third photosensitive drum 21M", and the photosensitive drum provided to the image formation unit 2Bk is referred to as a "fourth photosensitive drum 21Bk". Since the image formation units 2Y, 2C, 2M, and 2Bk have the same configuration, they are collectively referred to as an image formation unit 2.

The optical scanning device 23 is installed at the image forming apparatus 1 and forms an electrostatic image on the drum peripheral surface of the photosensitive drum 21 of each color. The optical scanning device 23 of the present embodiment includes an incident optical system having a plurality of light sources prepared for each color, a light deflection unit for deflecting light beams emitted from the light sources, and an image forming optical system for forming an image of the light beams deflected by the light deflection unit on the drum peripheral surface of the photosensitive drum 21 of each color and allowing the light beams to be scanned. The optical scanning device 23 will be described in detail later.

The intermediate transfer unit 28 primarily transfers the toner image formed on the photosensitive drum 21. The intermediate transfer unit 28 includes an intermediate transfer belt 281 (a transfer body) that circularly moves while contacting with the drum peripheral surface of each photosensitive drum 21, and a driving roller 282 and a driven roller 283 over which the intermediate transfer belt 281 is stretched. The intermediate transfer belt 281 is an endless belt having a width in the X direction (the right and left direction) and extending in the Y direction (the front and rear direction), and is pressed to the drum peripheral surface of each photosensitive drum 21 by the primary transfer roller 26. The toner images on the photosensitive drum 21 of each color are superposed on the intermediate transfer belt 281 and are primarily transferred. In this way, the toner images of full color are formed on the intermediate transfer belt 281.

A secondary transfer roller 29 is arranged to face the driving roller 282 and forms a secondary transfer nip portion T while interposing the intermediate transfer belt 281 between the secondary transfer roller 29 and the driving roller 282. The toner images of full color on the intermediate transfer belt 281 are secondarily transferred to a sheet at the secondary transfer nip portion T. Toner, which is not transferred onto the sheet and remains on a peripheral surface of the intermediate transfer belt 281, is collected by a belt cleaning device 284 arranged to face the driven roller 283.

The fixing unit 30 includes a fixing roller 31 having a heating source therein and a pressure roller 32 that forms a fixing nip portion N together with the fixing roller 31. The fixing unit 30 performs a fixing process for welding toner to the sheet, to which the toner images have been transferred at the secondary transfer nip portion T, by heating and pressurizing the sheet at the fixing nip portion N. The sheet subjected to the fixing process is discharged toward the sheet discharge tray 11 from the sheet discharge port 12.

The body housing 10 is provided therein with a sheet conveyance path for conveying a sheet. The sheet conveyance path includes a main conveyance path Q1 extending in the Z direction (the up and down direction) from the vicinity of the lower part of the body housing 10 to the vicinity of the upper part thereof via the secondary transfer nip portion T and the fixing unit 30. A downstream end of the main conveyance path Q1 is connected to the sheet discharge port 12. An inversion conveyance path Q2 for inverting and conveying a sheet at the time of duplex printing extends from the lowest downstream end of the main conveyance path Q1 to the vicinity of an upstream end thereof. Furthermore, a conveyance path Q3 for a manual feed sheet extending from the manual feed tray 13 to the main conveyance path Q1 is arranged above the sheet feeding cassette 14.

The sheet feeding cassette 14 includes a sheet receiving part for receiving a bundle of sheets. The sheet feeding cassette 14 is provided with a pickup roller 151 that delivers the uppermost sheets of the sheet bundle one by one and a sheet feeding roller pair 152 that sends the sheets to the upstream end of the main conveyance path Q1. Sheets placed on the manual feed tray 13 are also sent to the upstream end of the main conveyance path Q1 through the conveyance path Q3 for a manual feed sheet. At an upstream side of the main conveyance path Q1 from the secondary transfer nip portion T, a resist roller pair 153 is arranged to send sheets to the secondary transfer nip portion T at a predetermined timing.

When one side printing (image formation) is performed on a sheet, the sheet is sent to the main conveyance path Q1 from the sheet feeding cassette 14 or the manual feed tray 13, so that the transfer process of a toner image is performed on the sheet at the secondary transfer nip portion T and then the fixing process of the fixing unit 30 is performed to fix transferred toner to the sheet. Thereafter, the sheet is discharged onto the sheet discharge tray 11 from the sheet discharge port 12. On the other hand, when a duplex printing process is performed on a sheet, the transfer process and the fixing process are performed on one side of the sheet, and then a part of the sheet is discharged onto the sheet discharge tray 11 from the sheet discharge port 12. Thereafter, the sheet is switched back and conveyed and is returned to the vicinity of the upstream end of the main conveyance path Q1 through the inversion conveyance path Q2. Then, the transfer process and the fixing process are performed on the rear surface of the sheet and the sheet is discharged onto the sheet discharge tray 11 from the sheet discharge port 12.

[Detailed Configuration of Optical Scanning Device]

Figure 2:
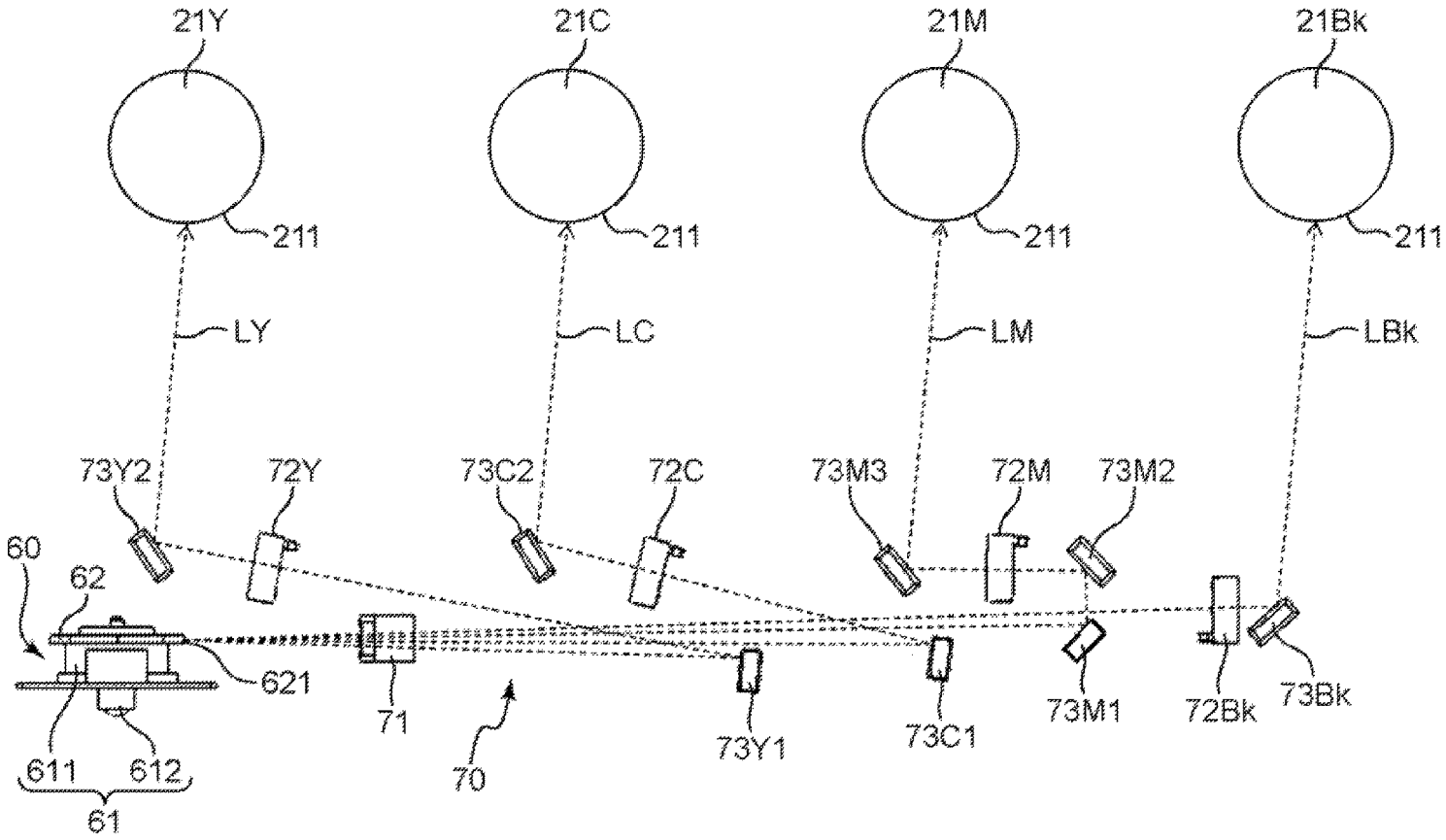
FIG. 2 is an optical path diagram illustrating a configuration of a sub-scanning section of an optical scanning device.
Figure 3:
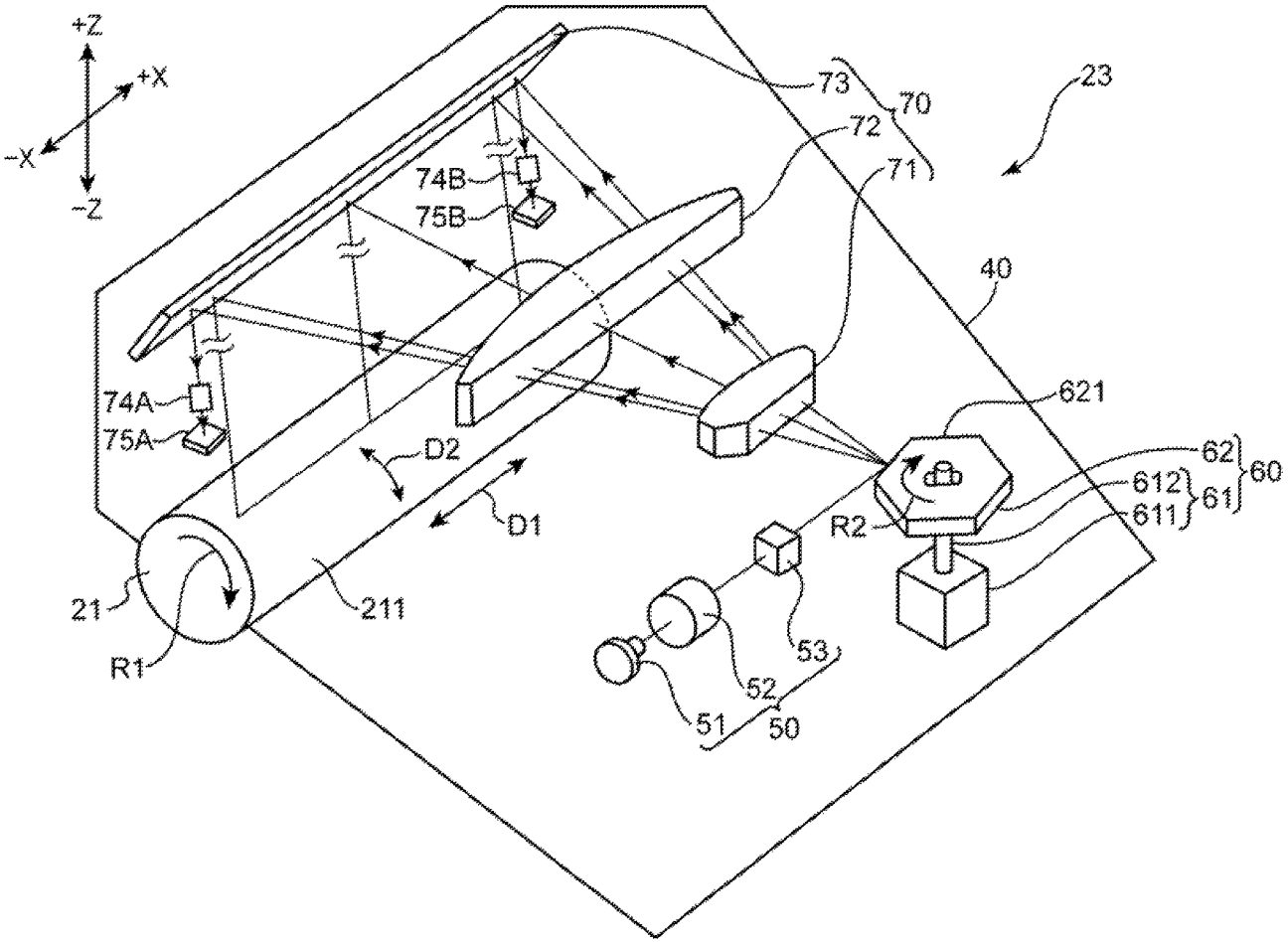
FIG. 3 is a perspective view schematically illustrating an internal configuration of an optical scanning device.
Figure 4:
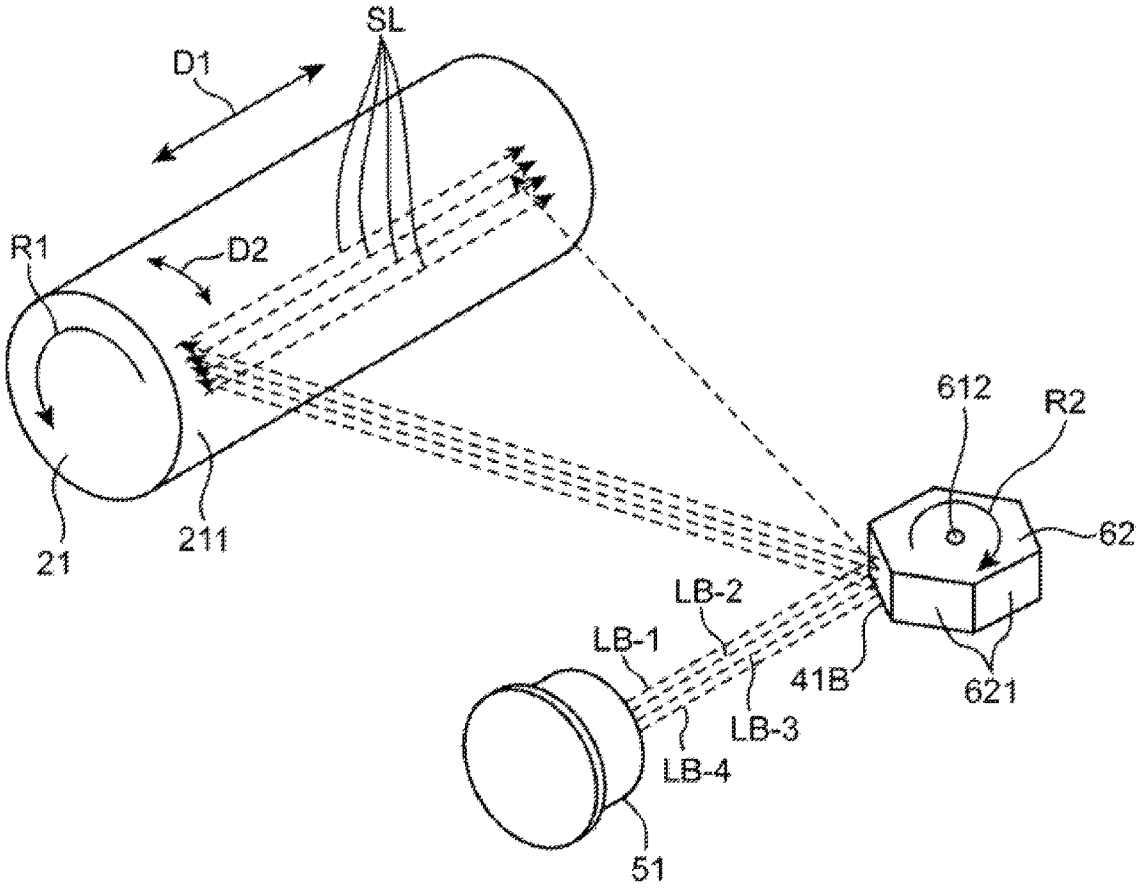
FIG. 4 is a schematic perspective view for explaining an exposure state of a photosensitive drum by an optical scanning device.
Figure 5:
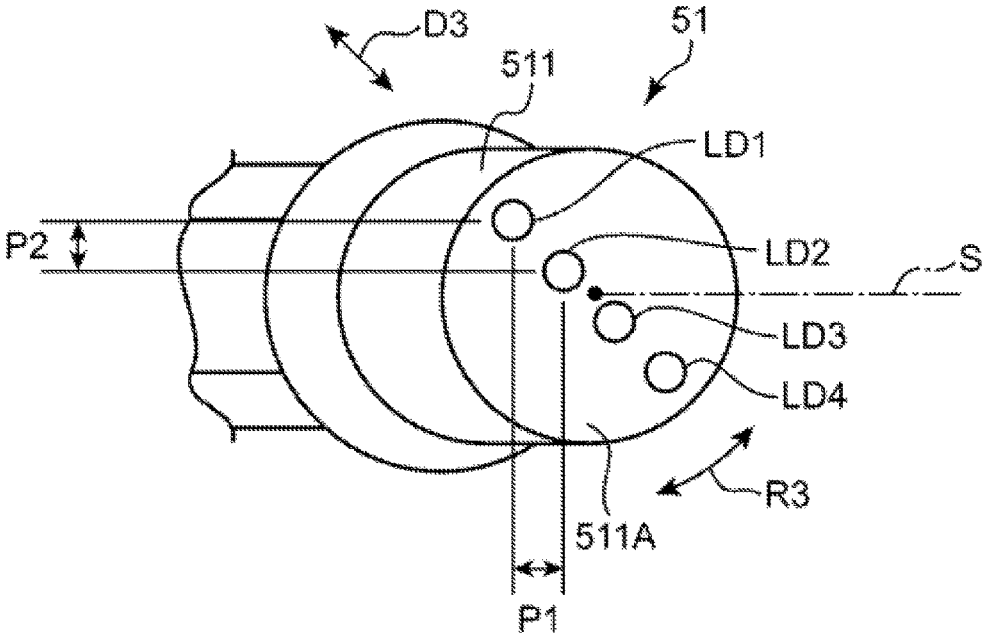
FIG. 5 is a perspective view illustrating a light source provided to an optical scanning device.

Next, the configuration of the optical scanning device 23 will be described in detail with reference to FIG. 2 to FIG. 5 in addition to FIG. 1. FIG. 2 is an optical path diagram illustrating a configuration of a sub-scanning section of the optical scanning device 23. FIG. 3 is a perspective view schematically illustrating an internal configuration of the optical scanning device 23. FIG. 4 is a schematic perspective view for explaining an exposure state of the photosensitive drum 21 by the optical scanning device 23. FIG. 5 is a perspective view illustrating a light source 51 provided to the optical scanning device 23.

The optical scanning device 23 scans the drum peripheral surfaces 211 of the first photosensitive drum 21Y for yellow, the second photosensitive drum 21C for cyan, the third photosensitive drum 21M for magenta, and the fourth photosensitive drum 21Bk for black with a yellow light beam LY (a laser light beam for yellow image drawing), a cyan light beam LC (a laser light beam for cyan image drawing), a magenta light beam LM (a laser light beam for magenta image drawing), and a black light beam LBk (a laser light beam for black image drawing) in a main scanning direction D1, thereby forming an electrostatic latent image on the drum peripheral surfaces 211. The main scanning direction D1 of scanning for the photosensitive drum 21 by the optical scanning device 23 coincides with the X direction (the right and left direction) which is an axis direction in which the photosensitive drum 21 extends.

The optical scanning device 23 includes an incident optical system 50, one light deflection unit 60 commonly used in four colors, an image forming optical system 70, an optical housing 40, and concentration detection units 80, wherein the incident optical system 50, the light deflection unit 60, and the image forming optical system 70 are arranged on optical paths of the light beams of each color and are received in the optical housing 40.

The incident optical system 50 is an optical system which is received in the optical housing 40 and allows the light beams of each color to be incident into a deflection surface 621 of a polygon mirror 62 (a deflector) constituting the light deflection unit 60 to be described later. The incident optical system 50 includes the light source 51, a collimator lens 52, and a cylindrical lens 53.

The light source 51 is a multibeam type light source that emits a plurality of light beams to be irradiated to the deflection surface 621 of the polygon mirror 62. As illustrated in FIG. 5, the light source 51 is a monolithic multi-laser diode in which four light emitting parts LD1 to LD4 are arranged with constant main scanning pitch P1 and sub-scanning pitch P2 in a predetermined arrangement direction D3 so as to emit light beams to a distal end surface 511A of a columnar plug member 511, wherein each of the light emitting parts LD1 to LD4 includes a laser diode (LD). In the present embodiment, an example, in which the monolithic multi-laser diode including the four light emitting parts, is described; however, it is sufficient if it is a monolithic multi-laser diode in which two or more light emitting parts are arranged on the same chip.

Referring to FIG. 3, the collimator lens 52 is a lens that converts the light beams, which are emitted from the light emitting parts LD1 to LD4 of the light source 51 and are diffused, into parallel light. The cylindrical lens 53 is a lens that converts the parallel light of the collimator lens into linear light long in the main scanning direction D1 and forms an image of the linear light on the deflection surface 621 of the polygon mirror 62.

Referring to FIG. 2 to FIG. 4, the light deflection unit 60 is received in the optical housing 40, reflects the light beam, the image of which has been formed by the cylindrical lens 53, and deflects and scans the reflected light beam. The light deflection unit 60 includes a polygon motor 61 and a polygon mirror 62. The polygon motor 61 includes a motor body 611 and a rotating shaft 612. In the polygon motor 61, the rotating shaft 612 is a shaft protruding from the motor body 611 and extending in the Z direction (the up and down direction). The polygon motor 61 is configured such that the rotating shaft 612 is rotated around an axial center when a driving current is inputted to the motor body 611.

The polygon mirror 62 is a polygon mirror in which six deflection surfaces 621 are formed along each side of a regular hexagon. In the polygon mirror 62, light beams LB-1 to LB-4, which have been emitted from the light emitting parts LD1 to LD4 of the light source 51 and has passed through the collimator lens 52 and the cylindrical lens 53, are irradiated to the deflection surfaces 621. The polygon mirror 62 is provided to be integrally rotated with the rotating shaft 612, is rotated around the rotating shaft 612 in an arrow R2 direction with the rotation of the rotating shaft 612, reflects the light beams LB-1 to LB-4 irradiated to the deflection surfaces 621, and deflects and scans the reflected light beams. Accordingly, the drum peripheral surface 211 of the photosensitive drum 21 can be scanned in the main scanning direction D1 with the light beams LB-1 to LB-4 deflected and scanned by the polygon mirror 62.

The image forming optical system 70 is received in the optical housing 40, forms images of the light beams LB-1 to LB-4 deflected and scanned by the polygon mirror 62 on the drum peripheral surface 211 of the photosensitive drum 21, and scans the light beams. As illustrated in FIG. 2, the image forming optical system 70 includes a first scanning lens 71, second scanning lenses 72Y, 72C, 72M, and 72Bk, reflection mirrors 73Y1 and 73Y2 for yellow for reflecting the yellow light beam LY, reflection mirrors 73C1 and 73C2 for cyan for reflecting the cyan light beam LC, reflection mirrors 73M1 to 73M3 for magenta for reflecting the magenta light beam LM, and a reflection mirror 73Bk for black for reflecting the black light beam LBk.

The first scanning lens 71 is a lens in which there is a proportional relation between an angle of an incident light beam and an image height and which has distortion aberration (fθ characteristic), and is a long lens extending along the main scanning direction D1. The first scanning lens 71 is arranged in the optical housing 40 so as to face the deflection surface 621 of the polygon mirror 62. The first scanning lens 71 collects the light beams LB-1 to LB-4 reflected by the deflection surface 621 of the polygon mirror 62.

Each of the second scanning lenses 72Y, 72C, 72M, and 72Bk is a lens having distortion aberration (fθ characteristic) and is a long lens extending along the main scanning direction D1, similarly to the first scanning lens 71. The second scanning lens 72Y collects the yellow light beam LY having passed through the first scanning lens 71 and allows an image of the yellow light beam LY to be formed on the drum peripheral surface 211 of the first photosensitive drum 21Y. The second scanning lens 72C collects the cyan light beam LC having passed through the first scanning lens 71 and allows an image of the cyan light beam LC to be formed on the drum peripheral surface 211 of the second photosensitive drum 21C. The second scanning lens 72M collects the magenta light beam LM having passed through the first scanning lens 71 and allows an image of the magenta light beam LM to be formed on the drum peripheral surface 211 of the third photosensitive drum 21M. The second scanning lens 72Bk collects the black light beam LBk having passed through the first scanning lens 71 and allows an image of the black light beam LBk to be formed on the drum peripheral surface 211 of the fourth photosensitive drum 21Bk. Since the second scanning lenses 72Y, 72C, 72M, and 72Bk have the same configuration, they may be collectively referred to as a second scanning lens 72 and FIG. 3 illustrates the collectively referred second scanning lens 72.

The reflection mirrors 73Y1 and 73Y2 for yellow reflect the yellow light beam LY, which has passed through the first scanning lens 71, on the image formation path of the yellow light beam LY. The reflection mirrors 73C1 and 73C2 for cyan reflect the cyan light beam LC, which has passed through the first scanning lens 71, on the image formation path of the cyan light beam LC. The reflection mirrors 73M1 to 73M3 for magenta reflect the magenta light beam LM, which has passed through the first scanning lens 71, on the image formation path of the magenta light beam LM. The reflection mirror 73Bk for black reflects the black light beam LBk, which has passed through the first scanning lens 71, on the image formation path of the black light beam LBk. Since the reflection mirrors 73Y1 and 73Y2 for yellow, the reflection mirrors 73C1 and 73C2 for cyan, the reflection mirrors 73M1 to 73M3, and the reflection mirror 73Bk for black have the same configuration, they are collectively referred to as a reflection mirror 73 and FIG. 3 illustrates the collectively referred reflection mirror 73.

Referring to FIG. 2, the yellow light beam LY reflected by the deflection surface 621 of the polygon mirror 62 is collected by the first scanning lens 71, is reflected by the reflection mirror 73Y1 for yellow, passes through the second scanning lens 72Y, and is reflected by the reflection mirror 73Y2 for yellow, so that an image of the yellow light beam LY is formed on the drum peripheral surface 211 of the first photosensitive drum 21Y. The cyan light beam LC reflected by the deflection surface 621 of the polygon mirror 62 is collected by the first scanning lens 71, is reflected by the reflection mirror 73C1 for cyan, passes through the second scanning lens 72C, and is reflected by the reflection mirror 73C2 for cyan, so that an image of the cyan light beam LC is formed on the drum peripheral surface 211 of the second photosensitive drum 21C. The magenta light beam LM reflected by the deflection surface 621 of the polygon mirror 62 is collected by the first scanning lens 71, is reflected by the reflection mirrors 73M1 and 73M2 for magenta, passes through the second scanning lens 72M, and is reflected by the reflection mirror 73M2 for magenta, so that an image of the magenta light beam LM is formed on the drum peripheral surface 211 of the third photosensitive drum 21M. The black light beam LBk reflected by the deflection surface 621 of the polygon mirror 62 is collected by the first scanning lens 71 and the second scanning lens and 72Bk and is reflected by the reflection mirror 73Bk for black, so that an image of the black light beam LBk is formed on the drum peripheral surface 211 of the fourth photosensitive drum 21Bk.

Furthermore, as illustrated in FIG. 3, the optical scanning device 23 of the present embodiment includes a first condensing lens 74A, a second condensing lens 74B, a first BD (Beam Detect) sensor 75A, and a second BD (Beam Detect) sensor 75B.

The first condensing lens 74A and the second condensing lens 74B are lenses that are installed on an optical path out of a range of an effective scanning area for the drum peripheral surface 211 of the photosensitive drum 21 by the polygon mirror 62, and form the images of the light beams LB-1 to LB-4 reflected by the deflection surface 621 of the polygon mirror 62 on the first BD sensor 75A and the second BD sensor 75B.

The first BD sensor 75A and the second BD sensor 75B detect the light beam LB-1 in order to make synchronization of a writing timing serving as a timing at which the irradiation of the light beam LB-1 to the drum peripheral surface 211 of the photosensitive drum 21 from the light emitting part LD1 (a reference light emitting part) is started. For the light emitting parts LD2 to LD4 serving as remaining light emitting parts except for the light emitting part LD1 (the reference light emitting part), the light emitting start timings of the light emitting parts LD2 to LD4 with respect to the light emitting part LD1 are set in accordance with the main scanning pitch P1. Details of the light emitting start timings will be described later. For main scanning lines SL drawn on the drum peripheral surface 211 of the photosensitive drum 21 by scanning of the light beams LB-1 to LB-4 emitted from the light emitting parts LD1 to LD4 along the main scanning direction D1, the first BD sensor 75A is arranged at a scanning start side and the second BD sensor 75B is arranged at a scanning end side. The first BD sensor 75A and the second BD sensor 75B include a photodiode and the like, and output a high level signal when the light beam LB-1 is not detected and output a low level signal while the light beam LB-1 is passing through light receiving surfaces thereof.

As illustrated in FIG. 4, the four light beams LB-1 to LB-4 are emitted from the light emitting parts LD1 to LD4 of the light source 51 toward the deflection surface 621 of the polygon mirror 62. The polygon mirror 62 is rotated by the polygon motor 61 at a high speed around the rotating shaft 612 in the arrow R2 direction. At a certain timing, the four light beams LB-1 to LB-4 are irradiated to one deflection surface 621 of the polygon mirror 62, and are refracted and reflected from the deflection surface 621 in a direction toward the drum peripheral surface 211 of the photosensitive drum 21. With the rotation of the polygon mirror 62, the four light beams LB-1 to LB-4 scan the drum peripheral surface 211 of the photosensitive drum 21 along the main scanning direction D1. In this way, on the drum peripheral surface 211 of the photosensitive drum 21, four main scanning lines SL are drawn. Since the four light beams LB-1 to LB-4 are modulated in accordance with image data transmitted from an external device such as a computer, an electrostatic latent image according to the image data is formed on the drum peripheral surface 211 of the photosensitive drum 21.

In the light source 51, the four light emitting parts LD1 to LD4 are arranged with the main scanning pitch P1 and the sub-scanning pitch P2 along the predetermined arrangement direction D3 as described above. Therefore, when the light emitting parts LD1 to LD4 emit light beams at the same light emitting start timing, the positions of beam spots of the light beams LB-1 to LB-4 on the drum peripheral surface 211 of the photosensitive drum 21 are different from one another in the main scanning direction D1 in accordance with the main scanning pitch P1 and are different from one another in the sub-scanning direction D2 in accordance with the sub-scanning pitch P2. That is, the four light beams LB-1 to LB-4 draw the four main scanning lines SL along the main scanning direction D1 in the state in which the light beams LB-1 to LB-4 are sequentially arranged in the sub-scanning direction D2. Accordingly, a beam pitch of the four main scanning lines SL in the sub-scanning direction D2 according to the four light beams LB-1 to LB-4, that is, the resolution (dpi) of an image to be drawn depends on the sub-scanning pitch P2 of the four light emitting parts LD1 to LD4. The sub-scanning direction D2 is a direction perpendicular to the main scanning direction D1 and is a direction along a rotation direction R1 of the photosensitive drum 21.

The beam pitch of the four main scanning lines SL in the sub-scanning direction D2 according to the four light beams LB-1 to LB-4 can be adjusted by rotating the light source 51. Specifically, the light source 51 is rotated in a direction of an arrow R3 by employing, as a rotation axis, a normal line S passing through the center of the distal end surface 511A among normal lines of the distal end surface 511A of the plug member 511, so that the sub-scanning pitch P2 of the four light emitting parts LD1 to LD4 can be apparently changed. That is, when the light source 51 is rotated around the axis of the normal line S in a clockwise direction, the beam pitch of the four main scanning lines SL in the sub-scanning direction D2 becomes large, but when the light source 51 is rotated in a counterclockwise direction, the beam pitch of the four main scanning lines SL in the sub-scanning direction D2 becomes small. Accordingly, a beam pitch according to a setting resolution of an image can be obtained by adjusting the rotation of the light source 51.

Furthermore, as illustrated in FIG. 1, the optical scanning device 23 includes the concentration detection units for detecting toner concentration of a toner image (hereinafter, referred to as a "patch image") with a specific pattern formed on the intermediate transfer belt 281. The concentration detection unit 80 includes a sensor such as a photodiode, irradiates light to the patch image formed on the intermediate transfer belt 281, receives its reflected light, and measures the toner concentration of the patch image by a light amount and the like of the received reflected light. In the present embodiment, the concentration detection units 80 are arranged so as to face both end portions of the intermediate transfer belt 281 in the width direction (the X direction, that is, the main scanning direction D1).

[Electrical Configuration of Image Forming Apparatus]

Figure 6:
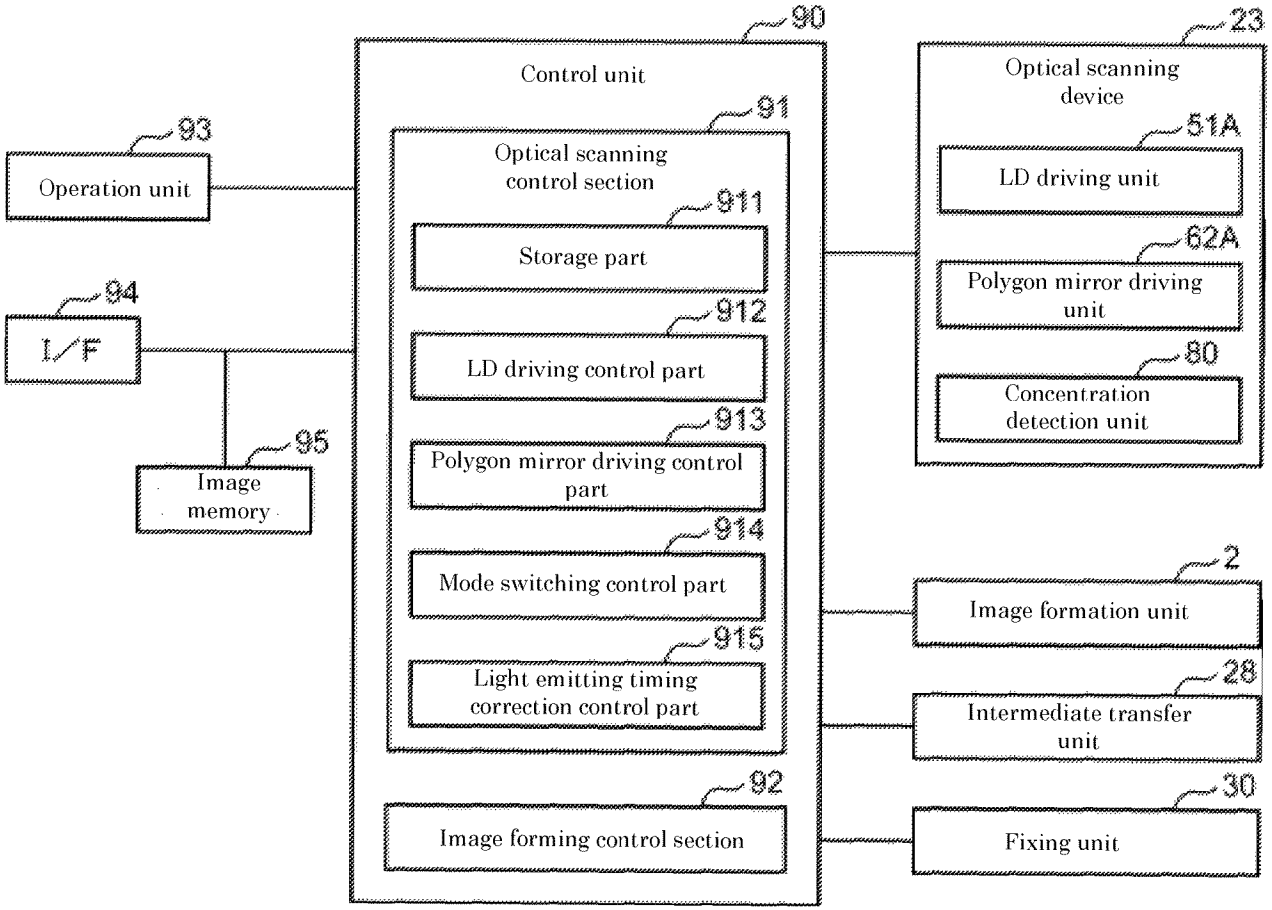
FIG. 6 is a block diagram illustrating an electrical configuration of an image forming apparatus.

Next, the electrical configuration of the image forming apparatus 1 will be described with reference to FIG. 6. FIG. 6 is a block diagram illustrating the electrical configuration of the image forming apparatus 1. The image forming apparatus 1 includes a control unit 90 that generally controls the operations of each element thereof, an operation unit 93, an I/F (interface) 94, and an image memory 95.

The control unit 90 includes a CPU (Central Processing Unit), a ROM (Read Only Memory) for storing a control program, a RAM (Random Access Memory) used as a work area of the CPU, and the like. The operation unit 93 includes a touch panel, a numeric keypad, a start key, a setting key and the like, and accepts an operation and various types of setting of a user with respect to the image forming apparatus 1. The image memory 95 temporarily stores image data sent from an external device. The I/F 94 is an interface circuit for performing data communication with the external device, and for example, creates a communication signal according to a communication protocol of a network that connects the image forming apparatus 1 to the external device, and converts a communication signal from the network side into data having a format processable by the image forming apparatus 1. A print instruction signal transmitted from the external device is sent to the control unit 90 via the I/F 94, and image data is stored in the image memory 95 via the I/F 94.

The CPU executes the control program stored in the ROM, so that the control unit 90 controls each element of the image forming apparatus 1 and controls an image forming operation of the image forming apparatus 1. In the present embodiment, the control unit 90 includes an optical scanning control section 91 and an image forming control section 92. The image forming control section 92 mainly controls the operations of the image formation unit 2 including the photosensitive drum 21, the intermediate transfer unit 28, and the fixing unit 30. The control of the image forming control section 92 includes control of a rotation operation around the axis of the photosensitive drum 21, an ON/OFF operation of the charging device 22, a development bias application operation of the development part 24, transfer bias application operations of the primary transfer roller 26 and the secondary transfer roller 29, a rotation operation of the intermediate transfer belt 281 in the intermediate transfer unit 28, and a fixing process operation of the fixing unit 30.

The optical scanning control section 91 serves as a control section that controls the optical scanning operation of the optical scanning device 23. The optical scanning control section 91 includes a storage part 911, a LD driving control part 912, a polygon mirror driving control part 913, a mode switching control part 914, and a light emitting timing correction control part 915.

When one of the light emitting parts LD1 to LD4 of the light source 51 is set as the reference light emitting part, the storage part 911 stores the light emitting start timings of the remaining light emitting parts, except for the reference light emitting part, with respect to the reference light emitting part, wherein the light emitting start timings are set in accordance with the main scanning pitch P1. In the present embodiment, among the light emitting parts LD1 to LD4, the light emitting part LD1, which is arranged at one end in the arrangement direction D3, is set as the reference light emitting part and the light emitting parts LD2 to LD4, except for the light emitting part LD1, are set as the remaining light emitting parts. The storage part 911 stores the light emitting start timings of the light emitting parts LD2 to LD4 with respect to the light emitting part LD1 serving as the reference light emitting part, wherein the light emitting start timings are set in accordance with the main scanning pitch P1.

The optical scanning device 23 is provided with a LD driving unit 51A which is a driver that drives the light emitting parts LD1 to LD4 of the light source 51. The LD driving control part 912 sends a light emitting control signal based on the image data of the image memory 95 to the LD driving unit 51A with reference to the light emitting start timings of the light emitting parts LD2 to LD4 with respect to the light emitting part LD1, which are stored in the storage part 911. The LD driving unit 51A, to which the light emitting control signal is sent by the LD driving control part 912, turns on the light emitting part LD1 to emit the light beam LB-1 and turns on the light emitting parts LD2 to LD4 on the basis of the light emitting start timings to emit the light beams LB-2 to LB-4, according to the light emitting control signal.

Furthermore, the optical scanning device 23 is provided with a polygon mirror driving unit 62A. The polygon mirror driving control part 913 sends a rotation control signal for rotating the polygon mirror 62 to the polygon mirror driving unit 62A. The polygon mirror driving unit 62A, to which the rotation control signal is sent by the polygon mirror driving control part 913, controls the rotation operation of the polygon mirror 62 by the polygon motor 61 according to the rotation control signal.

<Optical Scanning Operation of Optical Scanning Device>

Figure 7A:
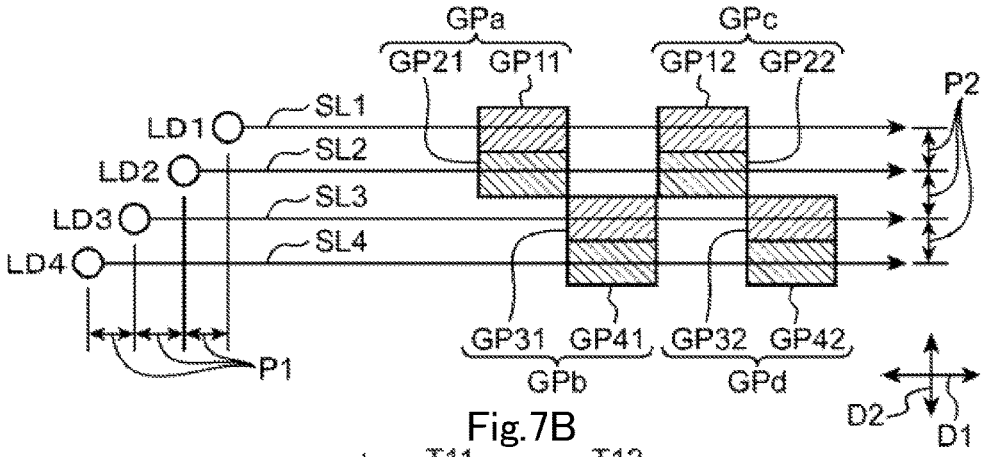
FIG. 7A to FIG. 7C are diagrams for explaining an optical scanning operation of an optical scanning device.
Figure 7B:
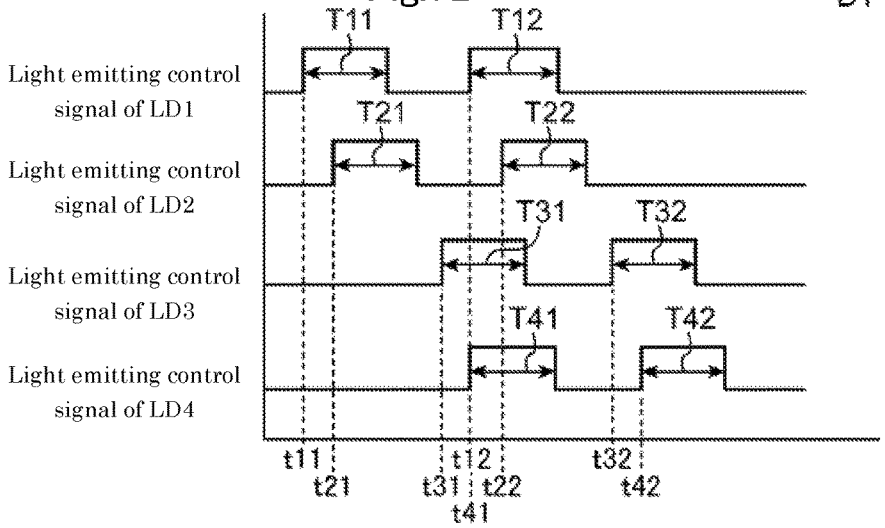
Figure 7C:
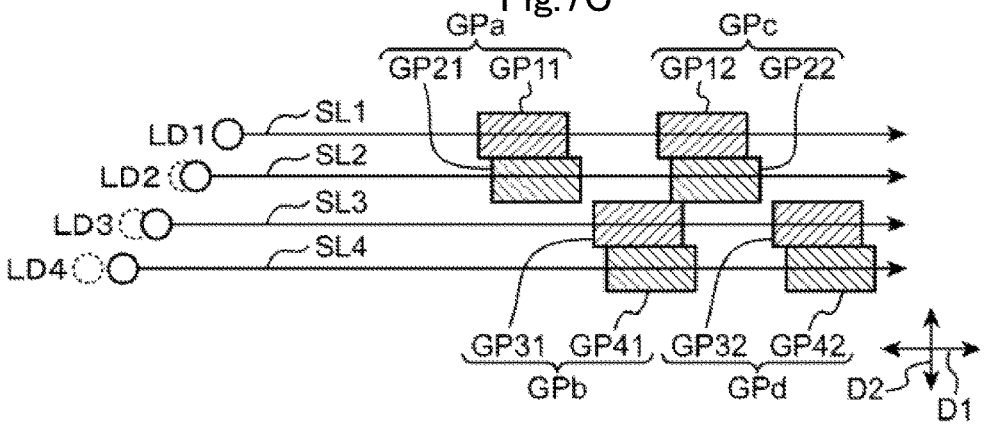

Hereinafter, the optical scanning operation of the optical scanning device 23 will be described with reference to FIG. 7. FIG. 7 is a diagram for explaining the optical scanning operation of the optical scanning device 23. FIG. 7A is a diagram for explaining the light emitting operations of the light emitting parts LD1 to LD4 with respect to each pixel constituting the image data of the image memory 95. FIG. 7B is a waveform diagram of the light emitting control signal sent to the LD driving unit 51A by the LD driving control part 912. FIG. 7C is a diagram for explaining the light emitting operations of the light emitting parts LD1 to LD4 in a state in which position shift occurs in the main scanning direction D1 with respect to installation positions of the light emitting parts LD1 to LD4.

FIG. 7A illustrates the light emitting operations of the light emitting parts LD1 to LD4 when an electrostatic latent image corresponding to image data including a pixel GPa, a pixel GPb, a pixel GPc, and a pixel GPd is formed on the drum peripheral surface 211 of the photosensitive drum 21. In the example illustrated in FIG. 7A, the pixel GPb is arranged at a position shifted from the pixel GPa by one pixel to a downstream side in the main scanning direction D1 and the sub-scanning direction D2, the pixel GPc is arranged at a position shifted from the pixel GPa by two pixels to the downstream side only in the main scanning direction D1, and the pixel GPd is arranged at a position shifted from the pixel GPa by three pixels to the downstream side in the main scanning direction D1 and shifted by one pixel to the downstream side in the sub-scanning direction D2. When the resolution of the image, for example, is 600 dpi, the size of one pixel is about 42 μm.

In the present embodiment, an upstream side area part GP11 of the pixel GPa in the sub-scanning direction D2 and an upstream side area part GP12 of the pixel GPc in the sub-scanning direction D2 are scanned by the light beam LB-1 emitted from the light emitting part LD1. Furthermore, a downstream side area part GP21 of the pixel GPa in the sub-scanning direction D2 and a downstream side area part GP22 of the pixel GPc in the sub-scanning direction D2 are scanned by the light beam LB-2 emitted from the light emitting part LD2. Furthermore, an upstream side area part GP31 of the pixel GPb in the sub-scanning direction D2 and an upstream side area part GP32 of the pixel GPd in the sub-scanning direction D2 are scanned by the light beam LB-3 emitted from the light emitting part LD3. Furthermore, a downstream side area part GP41 of the pixel GPb in the sub-scanning direction D2 and a downstream side area part GP42 of the pixel GPd in the sub-scanning direction D2 are scanned by the light beam LB-4 emitted from the light emitting part LD4.

That is, in the present embodiment, the sub-scanning pitches P2 of the light emitting parts LD1 to LD4 is set such that a beam pitch in the sub-scanning direction D2 in the main scanning lines SL1 to SL4 corresponds to a ½ pixel, wherein the main scanning lines SL1 to SL4 are drawn on the drum peripheral surface 211 of the photosensitive drum 21 by the light beams LB-1 to LB-4 emitted from the light emitting parts LD1 to LD4.

Moreover, the light emitting start timings of the light emitting parts LD2 to LD4 with respect to the light emitting part LD1 are set in accordance with the main scanning pitch P1 such that the light beam LB-2 and the light beam LB-1 are arranged at the same position in the main scanning direction D1 and the light beam LB-3 and the light beam LB-4 are arranged at positions shifted from the light beam LB-1 by one pixel to the downstream side in the main scanning direction D1, in relation to the positions of the beam spots of the light beams LB-1 to LB-4 from the light emitting parts LD1 to LD4 with respect to the drum peripheral surface 211 of the photosensitive drum 21. The light emitting start timings of the light emitting parts LD2 to LD4 are stored in the storage part 911.

The light emitting start timings of the light emitting parts LD2 to LD4 will be described below in more detail with reference to FIG. 7B. By a light emitting control signal used when performing the light emitting operation of the light emitting part LD1, a light emitting operation period T11, in which light emission is continued from a timing t11, is set in order to scan the upstream side area part GP11 of the pixel GPa in the sub-scanning direction D2, and, a light emitting operation period T12, in which light emission is continued from a timing t12, is set in order to scan the upstream side area part GP12 of the pixel GPc in the sub-scanning direction D2.

By a light emitting control signal used when performing the light emitting operation of the light emitting part LD2 with respect to the light emitting control signal of the light emitting part LD1 as described above, a light emitting operation period T21, in which light emission is continued from a timing t21, is set in order to scan the downstream side area part GP21 of the pixel GPa in the sub-scanning direction D2, and a light emitting operation period T22, in which light emission is continued from a timing t22, is set in order to scan the downstream side area part GP22 of the pixel GPc in the sub-scanning direction D2. The timing t21 and the timing t22 of the light emitting part LD2 correspond to the light emitting start timing of the light emitting part LD2 with respect to the pixel GPa and the pixel GPc. The timing t21 and the timing t22 serving as the light emitting start timing of the light emitting part LD2 are timings delayed in accordance with the main scanning pitch P1 with respect to the timing t11 and the timing t12 of the light emitting part LD1 such that the light beam LB-2 of the light emitting part LD2 scans the pixel GPa and the pixel GPc together with the light beam LB-1 of the light emitting part LD1.

By a light emitting control signal used when performing the light emitting operation of the light emitting part LD3, a light emitting operation period T31, in which light emission is continued from a timing t31, is set in order to scan the upstream side area part GP31 of the pixel GPb in the sub-scanning direction D2, and a light emitting operation period T32, in which light emission is continued from a timing t32, is set in order to scan the upstream side area part GP32 of the pixel GPd in the sub-scanning direction D2. The timing t31 and the timing t32 of the light emitting part LD3 correspond to the light emitting start timing of the light emitting part LD3 with respect to the pixel GPb and the pixel GPd. The timing t31 and the timing t32 serving as the light emitting start timing of the light emitting part LD3 are timings delayed in accordance with the main scanning pitch P1 with respect to the timing t11 and the timing t12 of the light emitting part LD1 such that the light beam LB-3 of the light emitting part LD3 scans the pixel GPb and the pixel GPd shifted from the pixel GPa and the pixel GPc by one pixel to the downstream side in the main scanning direction D1.

By a light emitting control signal used when performing the light emitting operation of the light emitting part LD4, a light emitting operation period T41, in which light emission is continued from a timing t41, is set in order to scan the downstream side area part GP41 of the pixel GPb in the sub-scanning direction D2, and a light emitting operation period T42, in which light emission is continued from a timing t42, is set in order to scan the downstream side area part GP42 of the pixel GPd in the sub-scanning direction D2. The timing t41 and the timing t42 of the light emitting part LD4 correspond to the light emitting start timing of the light emitting part LD4 with respect to the pixel GPb and the pixel GPd. The timing t41 and the timing t42 serving as the light emitting start timing of the light emitting part LD4 are timings delayed in accordance with the main scanning pitch P1 with respect to the timing t11 and the timing t12 of the light emitting part LD1 such that the light beam LB-4 of the light emitting part LD4 scans the pixel GPb and the pixel GPd shifted from the pixel GPa and the pixel GPc by one pixel to the downstream side in the main scanning direction D1.

When the light emitting operations of the light emitting parts LD1 to LD4 of the light source 51 are continuously performed by continuous running and the like of the image forming apparatus 1, since the temperature of the optical housing 40 rises due to heat generation by the light emission of the light emitting parts LD1 to LD4, there is a case where the optical housing 40 is thermally deformed due to the temperature rise. When the optical housing 40 is thermally deformed as described above, there is a case where arrangement positions (positions indicated by solid lines of the drawing) of the light emitting parts LD2 to LD4 with respect to the light emitting part LD1 serving as the reference light emitting part are shifted from design positions (positions indicated by broken lines of the drawing) in the main scanning direction D1. The position shift amounts of the light emitting parts LD2 to LD4 with respect to the light emitting part LD1 in the main scanning direction D1 become large in sequence of the light emitting part LD2, the light emitting part LD3, and the light emitting part LD4 in accordance with separation distances from the light emitting part LD1 in the main scanning direction D1.

In the state in which the position shift occurs in the light emitting parts LD2 to LD4 with respect to the design positions in the main scanning direction D1, when the LD driving control part 912 sends the light emitting control signal based on the image data of the image memory 95 to the LD driving unit 51A with reference to the light emitting start timings of the light emitting parts LD2 to LD4 with respect to the light emitting part LD1, which are stored in the storage part 911, position shift occurs in pixels of an electrostatic latent image which is formed on the drum peripheral surface 211 of the photosensitive drum 21.

In this regard, in the optical scanning device 23 of the present embodiment, the optical scanning control section 91 is configured to be able to perform a correction mode for correcting the light emitting start timings of the light emitting parts LD2 to LD4 with respect to the light emitting part LD1, which are stored in the storage part 911. Specifically, the optical scanning control section 91 includes the mode switching control part 914 and the light emitting timing correction control part 915.

The mode switching control part 914 performs control for switching a normal mode and the correction mode. The normal mode is a mode for forming the electrostatic latent image according to the image data of the image memory 95 on the drum peripheral surface 211 of the photosensitive drum 21. When the normal mode is performed by the mode switching control part 914, the LD driving control part 912 sends the light emitting control signal based on the image data of the image memory 95 to the LD driving unit 51A with reference to the light emitting start timings of the light emitting parts LD2 to LD4 with respect to the light emitting part LD1, which are stored in the storage part 911. The LD driving unit 51A, to which the light emitting control signal is sent by the LD driving control part 912, turns on the light emitting part LD1 to emit the light beam LB-1 and turns on the light emitting parts LD2 to LD4 on the basis of the light emitting start timings to emit the light beams LB-2 to LB-4, according to the light emitting control signal as described above.

On the other hand, the correction mode is a mode for correcting the light emitting start timings of the light emitting parts LD2 to LD4 with respect to the light emitting part LD1, which are stored in the storage part 911. When the correction mode is performed by the mode switching control part 914, the light emitting timing correction control part 915 performs control for forming electrostatic latent images corresponding to patch images on the drum peripheral surface 211 of the photosensitive drum 21 in order to form the patch images on the intermediate transfer belt 281. In the present embodiment, the light emitting timing correction control part 915 performs control for forming the electrostatic latent images on the drum peripheral surface 211 of the photosensitive drum 21 such that the patch images are formed at both end portions of the intermediate transfer belt 281 in the width direction (the X direction, that is, the main scanning direction D1). Toner concentration of the patch images formed on the intermediate transfer belt 281 is measured by the concentration detection unit 80.

<Control Operation of Optical Scanning Device in Correction Mode>

Figure 8:
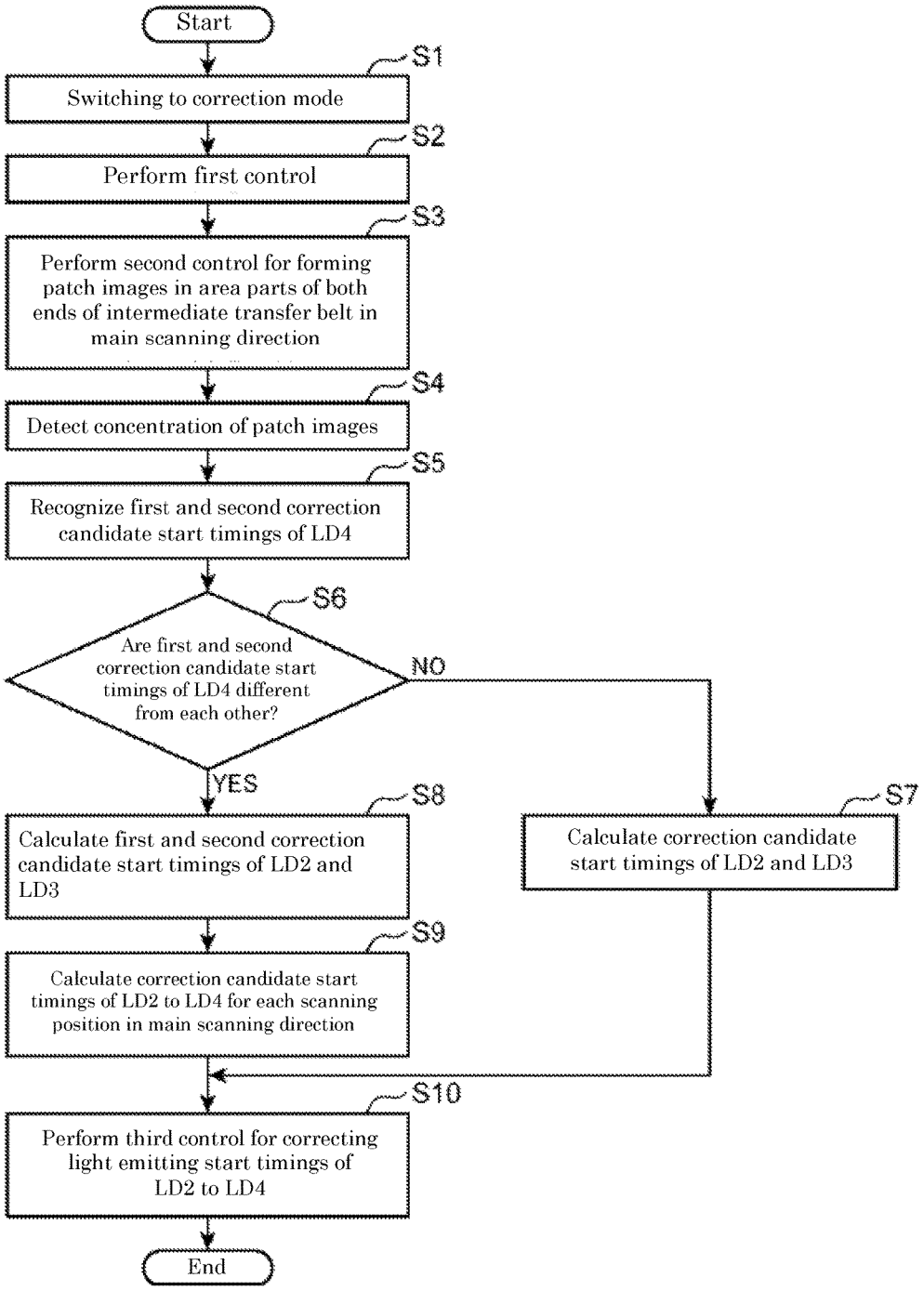
FIG. 8 is a flowchart illustrating a control operation in a correction mode of an optical scanning device.

The control operation of the optical scanning device 23 in the correction mode will be described with reference to FIG. 8. FIG. 8 is a flowchart illustrating the control operation of the optical scanning device 23 in the correction mode. In the optical scanning device 23, when an instruction signal of a user for performing the correction mode is inputted via the operation unit 93, the correction mode starts to be performed. In step S1, the mode switching control part 914 performs switching control from the normal mode to the correction mode.

In step S2, the light emitting timing correction control part 915 performs first control for allowing positions of beam spots of light beams on the drum peripheral surface 211 of the photosensitive drum 21 to be equal to each other, wherein the light beams are emitted from the light emitting part LD1 serving as the reference light emitting part and one first remaining light emitting part of the light emitting parts LD2 to LD4 serving as the remaining light emitting parts.

The first remaining light emitting part may be any one of the light emitting parts LD2 to LD4; however, in the present embodiment, the light emitting part LD4 arranged at the other end opposite to one end in the arrangement direction D3, in which the light emitting part LD1 serving as the reference light emitting part is arranged, is set as the first remaining light emitting part. In the light source 51, when position shift of the light emitting parts LD2 to LD4 with respect to the light emitting part LD1 occurs in the main scanning direction D1, the position shift amount becomes maximum in the light emitting part LD4 remotest from the light emitting part LD1 in the main scanning direction D1. Therefore, a change amount of a light emitting start timing to be corrected also becomes maximum in the light emitting part LD4 in which the position shift amount is maximum among the remaining light emitting parts. Accordingly, the light emitting part LD4, which is remotest from the light emitting part LD1 in the main scanning direction D1 among the remaining light emitting parts, is set as the first remaining light emitting part, so that the calculation accuracy of a change amount of a light emitting start timing according to the position shift amount in the light emitting part LD4 becomes high, resulting in the improvement of the correction accuracy of the light emitting start timings of the light emitting parts LD2 to LD4 based on the change amount of the light emitting start timing in the light emitting part LD4.

Furthermore, the control operation of the light emitting timing correction control part 915 in step S2 will be described in detail. The light emitting timing correction control part 915 performs the first control for allowing the positions of the beam spots of the light beams LB-1 and Lb-4 from the light emitting part LD1 and the light emitting part LD4 on the drum peripheral surface 211 of the photosensitive drum 21 to be equal to each other by controlling the image forming control section 92 to adjust the rotation speed of the photosensitive drum 21 (adjust the rotation speed to a rotation speed corresponding to ¾ of a rotation speed in the normal mode). That is, in the first control, the rotation speed of the photosensitive drum 21 is adjusted to achieve scanning due to multiple exposure of the light beams LB-1 and Lb-4 emitted from the light emitting part LD1 and the light emitting part LD4. Moreover, the light emitting timing correction control part 915 also controls the image forming control section 92 to adjust the rotation speed of the intermediate transfer belt 281 in accordance with the rotation speed of the photosensitive drum 21.

In step S3, the light emitting timing correction control part 915 performs second control for allowing the LD driving control part 912 to control the LD driving unit 51A. Specifically, the light emitting timing correction control part 915 allows the light beam LB-1 to be emitted from the light emitting part LD1, and allows the light beam LB-4 to be emitted from the light emitting part LD4 at a plurality of different start timings on the basis of the light emitting start timing stored in the storage part 911 and corresponding to the light emitting part LD4, thereby allowing electrostatic latent images to be formed in different areas of the drum peripheral surface 211 of the photosensitive drum 21 in accordance with the start timings. In this way, patch images corresponding to the electrostatic latent images formed on each area of the drum peripheral surface 211 of the photosensitive drum 21 are formed in different area parts of the intermediate transfer belt 281 in accordance with the start timings.

The second control performed by the light emitting timing correction control part 915 in step S3 will be described in detail with reference to FIG. 9 to FIG. 11. FIG. 9 to FIG. 11 are diagrams for explaining the second control performed in the correction mode. FIG. 9 is a diagram when no position shift occurs in the light emitting parts LD2 to LD4 of the light source 51. FIG. 10 is a diagram when position shift occurs in the light emitting parts LD2 to LD4 of the light source 51. FIG. 11 is a diagram illustrating the state of the intermediate transfer belt 281 with the formed patch images.

The second control performed by the light emitting timing correction control part 915 in step S3 is control for allowing the patch images to be formed in a plurality of area parts in areas A1 and A2 of both end portions of the intermediate transfer belt 281 in the main scanning direction D1 in accordance with each start timing of the light emitting part LD4.

In the example illustrated in FIG. 11, in the area A1 of one end portion in the main scanning direction D1 of the intermediate transfer belt 281 moved in a movement direction H1, a first area part A11, a second area part A12, a third area part A13, a fourth area part A14, and a fifth area part A15 are respectively set from the upstream to the downstream in the movement direction H1. In the first area part A11, a first patch image G11 configured by a pixel group GP1Ga including a plurality of pixels GP1*a* is formed. In the second area part A12, a second patch image G12 configured by a pixel group GP1Gb including a plurality of pixels GP1*b* is formed. In the third area part A13, a third patch image G13 configured by a pixel group GP1G including a plurality of pixels GP1 is formed. In the fourth area part A14, a fourth patch image G14 configured by a pixel group GP1Gc including a plurality of pixels GP1*c* is formed. In the fifth area part A15, a fifth patch image G15 configured by a pixel group GP1Gd including a plurality of pixels GP1*d* is formed.

On the other hand, in the area A2 of the other end portion in the main scanning direction D1 of the intermediate transfer belt 281 moved in the movement direction H1, a sixth area part A21, a seventh area part A22, an eighth area part A23, a ninth area part A24, and a tenth area part A25 are respectively set from the upstream to the downstream in the movement direction H1. In the sixth area part A21, a sixth patch image G21 configured by a pixel group GP2Ga including a plurality of pixels GP2*a* is formed. In the seventh area part A22, a seventh patch image G22 configured by a pixel group GP2Gb including a plurality of pixels GP2*b* is formed. In the eighth area part A23, an eighth patch image G23 configured by a pixel group GP2G including a plurality of pixels GP2 is formed. In the ninth area part A24, a ninth patch image G24 configured by a pixel group GP2Gc including a plurality of pixels GP2*c* is formed. In the tenth area part A25, a tenth patch image G25 configured by a pixel group GP2Gd including a plurality of pixels GP2*d* is formed.

Figure 9A:
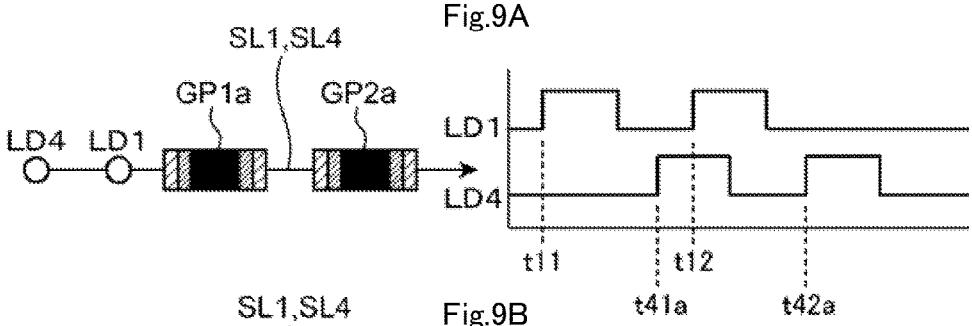
FIG. 9A to FIG. 9E are diagrams for explaining second control performed in a correction mode, and are diagrams when no position shift occurs in each light emitting part of a light source.
Figure 10A:
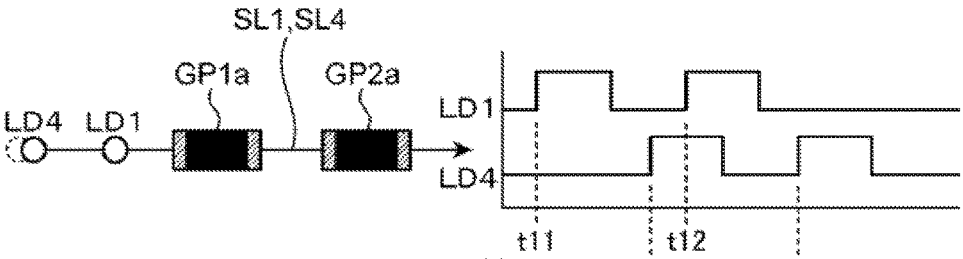
FIG. 10A to FIG. 10E are diagrams for explaining second control performed in a correction mode, and are diagrams when position shift occurs in each light emitting part of a light source.
Figure 11:
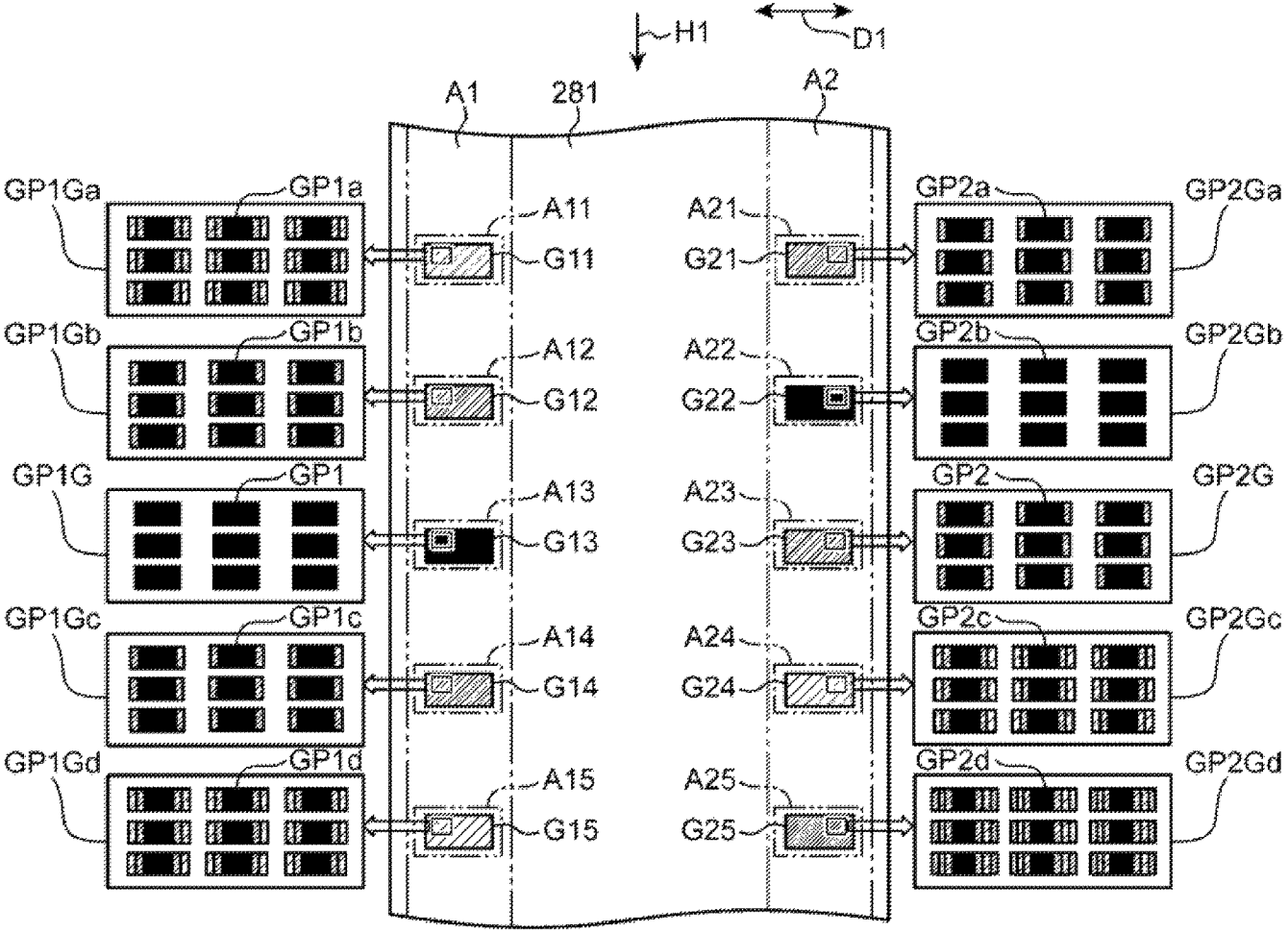
FIG. 11 is a diagram for explaining second control performed in a correction mode, and a diagram illustrating a state of an intermediate transfer belt on which patch images are formed.

Referring to FIG. 9A and FIG. 10A, each pixel GP1*a* of the pixel group GP1Ga constituting the first patch image G11 formed in the first area part A11 corresponds to an electrostatic latent image formed on the drum peripheral surface 211 of the photosensitive drum 21 by scanning due to multiple exposure of the light beam LB-1 emitted from the light emitting part LD1 at the timing t11 and the light beam LB-4 emitted from the light emitting part LD4 at a timing t41*a* delayed from the timing t11. Furthermore, each pixel GP2*a* of the pixel group GP2Ga constituting the sixth patch image G21 formed in the sixth area part A21 corresponds to an electrostatic latent image formed on the drum peripheral surface 211 of the photosensitive drum 21 by scanning due to multiple exposure of the light beam LB-1 emitted from the light emitting part LD1 at the timing t12 and the light beam LB-4 emitted from the light emitting part LD4 at a timing t42*a* delayed from the timing t12. The timing t41*a* and the timing t42*a*, which are the start timings of light emission by the light emitting part LD4, are timings earlier than the light emitting start timing of the light emitting part LD4 with respect to the light emitting part LD1, which is stored in the storage part 911, and are timings on the assumption that the positions of the beams spots are shifted to the upstream side in the main scanning direction D1 by ½ pixel.

Figure 9B:
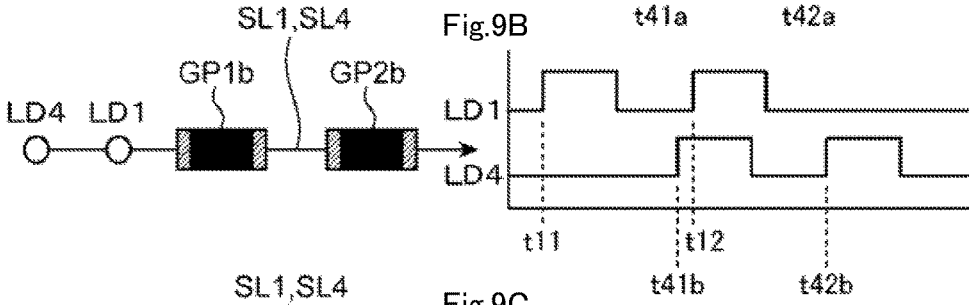
Figure 10B:
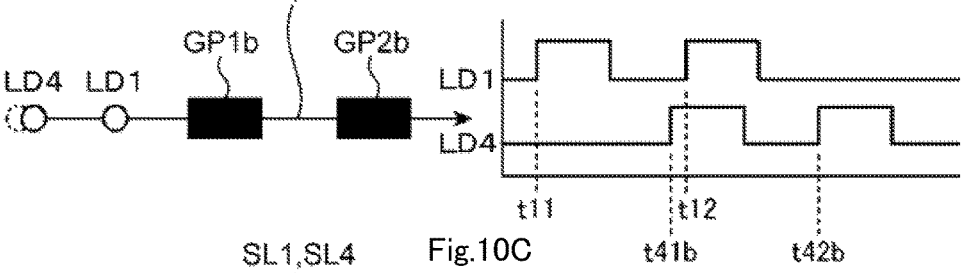

Referring to FIG. 9B and FIG. 10B, each pixel GP1*b* of the pixel group GP1Gb constituting the second patch image G12 formed in the second area part A12 corresponds to an electrostatic latent image formed on the drum peripheral surface 211 of the photosensitive drum 21 by scanning due to multiple exposure of the light beam LB-1 emitted from the light emitting part LD1 at the timing t11 and the light beam LB-4 emitted from the light emitting part LD4 at a timing t41*b* delayed from the timing t11. Furthermore, each pixel GP2*b* of the pixel group GP2Gb constituting the seventh patch image G22 formed in the seventh area part A22 corresponds to an electrostatic latent image formed on the drum peripheral surface 211 of the photosensitive drum 21 by scanning due to multiple exposure of the light beam LB-1 emitted from the light emitting part LD1 at the timing t12 and the light beam LB-4 emitted from the light emitting part LD4 at a timing t42*b* delayed from the timing t12. The timing t41*b* and the timing t42*b*, which are the start timings of light emission by the light emitting part LD4, are timings earlier than the light emitting start timing of the light emitting part LD4 with respect to the light emitting part LD1, which is stored in the storage part 911, and are timings on the assumption that the positions of the beams spots are shifted to the upstream side in the main scanning direction D1 by ¼ pixel.

Figure 9C:
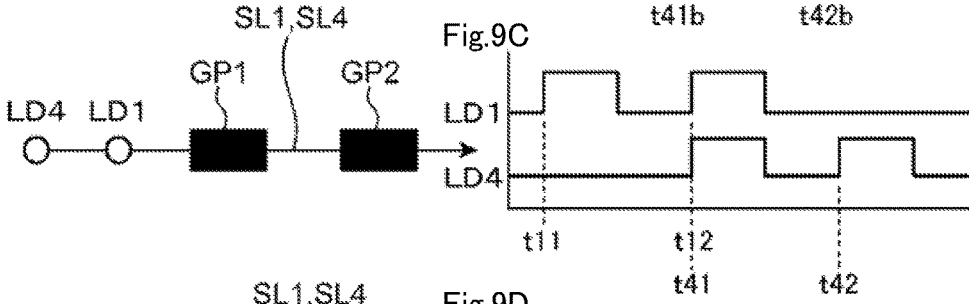
Figure 10C:
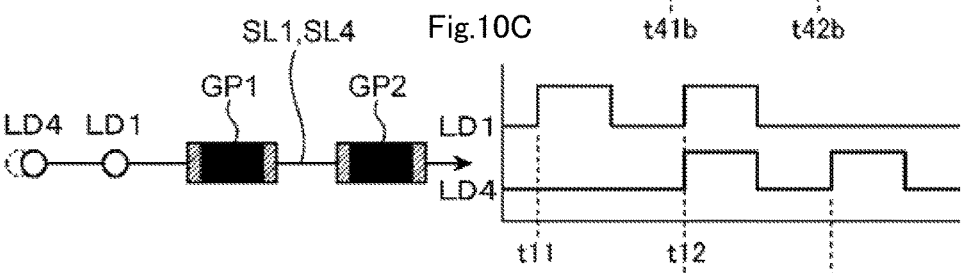

Referring to FIG. 9C and FIG. 10C, each pixel GP1 of the pixel group GP1G constituting the third patch image G13 formed in the third area part A13 corresponds to an electrostatic latent image formed on the drum peripheral surface 211 of the photosensitive drum 21 by scanning due to multiple exposure of the light beam LB-1 emitted from the light emitting part LD1 at the timing t11 and the light beam LB-4 emitted from the light emitting part LD4 at a timing t41 delayed from the timing t11. Furthermore, each pixel GP2 of the pixel group GP2G constituting the eighth patch image G23 formed in the eighth area part A23 corresponds to an electrostatic latent image formed on the drum peripheral surface 211 of the photosensitive drum 21 by scanning due to multiple exposure of the light beam LB-1 emitted from the light emitting part LD1 at the timing t12 and the light beam LB-4 emitted from the light emitting part LD4 at a timing t42 delayed from the timing t12. The timing t41 and the timing t42, which are the start timings of light emission by the light emitting part LD4, are timings equal to the light emitting start timing of the light emitting part LD4 with respect to the light emitting part LD1, which is stored in the storage part 911.

Figure 9D:
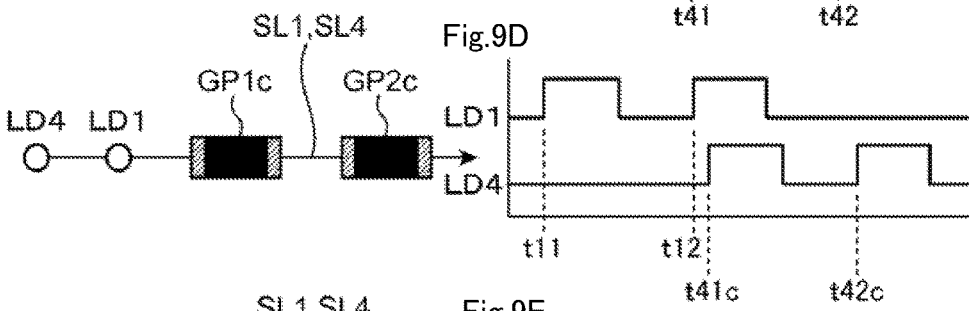
Figure 10D:
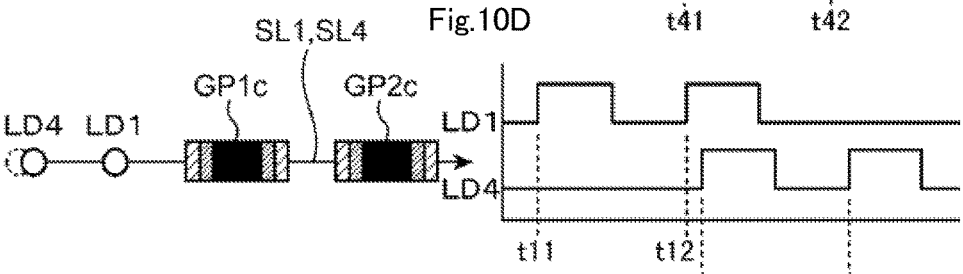

Referring to FIG. 9D and FIG. 10D, each pixel GP1*c* of the pixel group GP1Gc constituting the fourth patch image G14 formed in the fourth area part A14 corresponds to an electrostatic latent image formed on the drum peripheral surface 211 of the photosensitive drum 21 by scanning due to multiple exposure of the light beam LB-1 emitted from the light emitting part LD1 at the timing t11 and the light beam LB-4 emitted from the light emitting part LD4 at a timing t41*c* delayed from the timing 11. Furthermore, each pixel GP2*c* of the pixel group GP2Gc constituting the ninth patch image G24 formed in the ninth area part A24 corresponds to an electrostatic latent image formed on the drum peripheral surface 211 of the photosensitive drum 21 by scanning due to multiple exposure of the light beam LB-1 emitted from the light emitting part LD1 at the timing t12 and the light beam LB-4 emitted from the light emitting part LD4 at a timing t42*c* delayed from the timing t12. The timing t41*c* and the timing t42*c*, which are the start timings of light emission by the light emitting part LD4, are timings delayed from the light emitting start timing of the light emitting part LD4 with respect to the light emitting part LD1, which is stored in the storage part 911, and are timings on the assumption that the positions of the beams spots are shifted to the downstream side in the main scanning direction D1 by ¼ pixel.

Figure 9E:
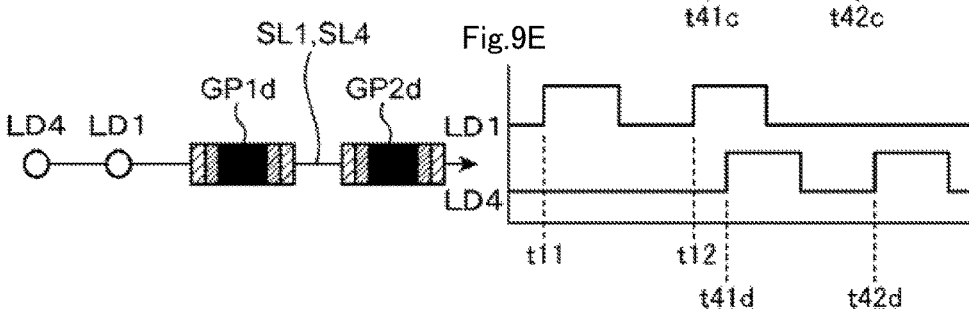
Figure 10E:
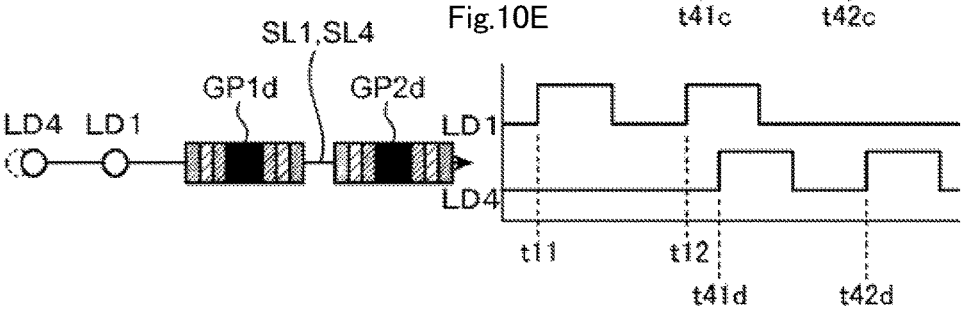

Referring to FIG. 9E and FIG. 10E, each pixel GP1*d* of the pixel group GP1Gd constituting the fifth patch image G15 formed in the fifth area part A15 corresponds to an electrostatic latent image formed on the drum peripheral surface 211 of the photosensitive drum 21 by scanning due to multiple exposure of the light beam LB-1 emitted from the light emitting part LD1 at the timing t11 and the light beam LB-4 emitted from the light emitting part LD4 at a timing told delayed from the timing t11. Furthermore, each pixel GP2*d* of the pixel group GP2Gd constituting the tenth patch image G25 formed in the tenth area part A25 corresponds to an electrostatic latent image formed on the drum peripheral surface 211 of the photosensitive drum 21 by scanning due to multiple exposure of the light beam LB-1 emitted from the light emitting part LD1 at the timing t12 and the light beam LB-4 emitted from the light emitting part LD4 at a timing t42*d* delayed from the timing t12. The timing t41*d* and the timing t42*d*, which are the start timings of light emission by the light emitting part LD4, are timings delayed from the light emitting start timing of the light emitting part LD4 with respect to the light emitting part LD1, which is stored in the storage part 911, and are timings on the assumption that the positions of the beams spots are shifted to the downstream side in the main scanning direction D1 by ½ pixel.

In the case of the scanning due to the multiple exposure of the light beams LB-1 and LB-4 emitted from the light emitting part LD1 and the light emitting part LD4, the main scanning line SL1 drawn by the light beam LB-1 and the main scanning line SL4 drawn by the light beam LB-4 overlap each other. Furthermore, an overlap length of the light beams LB-1 and LB-4 on the main scanning lines SL1 and SL4, which are emitted from the light emitting part LD1 and the light emitting part LD4, is changed in accordance with the start timings of light emission by the light emitting part LD4. As the overlap length of the light beams LB-1 and LB-4 is long, the toner concentration of the patch images formed on the intermediate transfer belt 281 becomes high.

In the case where no position shift occurs in the light emitting parts LD1 to LD4 of the light source 51, the overlap length of the light beams LB-1 and LB-4 emitted from the light emitting part LD1 and the light emitting part LD4 becomes longest when the start timings of light emission by the light emitting part LD4 are equal to the light emitting start timing of the light emitting part LD4 stored in the storage part 911 (see FIG. 9C). Accordingly, the patch images in this case has the highest toner concentration. Furthermore, as a shift amount of the start timings of light emission by the light emitting part LD4 with respect to the light emitting start timing is increased, the overlap length of the light beams LB- and LB-4 is shortened (see FIGS. 9A, 9B, 9C, and 9E). Accordingly, as the shift amount of the start timings of light emission by the light emitting part LD4 with respect to the light emitting start timing is increased, the toner concentration of the patch images becomes low.

On the other hand, in the case where position shift occurs in the light emitting parts LD1 to LD4 of the light source 51, the start timings of light emission by the light emitting part LD4 when the overlap length of the light beams LB-1 and LB-4 emitted from the light emitting part LD1 and the light emitting part LD4 becomes longest is a timing shifted from the light emitting start timing of the light emitting part LD4, which is stored in the storage part 911, in accordance with a position shift amount for design positions (positions indicated by broken lines of the drawing) of the light emitting part LD4, as illustrated in FIG. 10. In the example illustrated in FIG. 10, when the start timings of light emission by the light emitting part LD4 are timings earlier than the light emitting start timing and are the timings on the assumption that the positions of the beams spots are shifted to the upstream side in the main scanning direction D1 by ¼ pixel, the overlap length of the light beams LB-1 and LB-4 emitted from the light emitting part LD1 and the light emitting part LD4 becomes longest (see FIG. 10B). Accordingly, the patch images in this case has the highest toner concentration.

In step S4, the concentration detection unit 80 detects the toner concentration of the first to tenth patch images G11, G12, G13, G14, G15, G21, G22, G23, G24, and G25 respectively formed in the first to tenth area parts A11, A12, A13, A14, A15, A21, A22, A23, A24, and A25 in the areas A1 and A2 of both end portions of the intermediate transfer belt 281 in the main scanning direction D1.

In step S5, the light emitting timing correction control part 915 recognizes the light emitting start timing of the light emitting part LD4, at which the patch images has the highest toner concentration, in correspondence to the areas A1 and A2 of both end portions of the intermediate transfer belt 281 in the main scanning direction D1. Hereinafter, the start timing of the light emitting part LD4, which corresponds to the area A1 of the one end portion of the intermediate transfer belt 281 in the main scanning direction and causes the patch images to have the highest toner concentration, will be referred to as a first correction candidate start timing of the light emitting part LD4. Furthermore, the start timing of the light emitting part LD4, which corresponds to the area A2 of the other end portion of the intermediate transfer belt 281 in the main scanning direction and causes the patch images to have the highest toner concentration, will be referred to as a second correction candidate start timing of the light emitting part LD4. In the example illustrated in FIG. 11, in the area A1 of the one end portion of the intermediate transfer belt 281 in the main scanning direction D1, the third patch image G13 formed in the third area part A13 has the highest toner concentration, and the start timing of the light emitting part LD4 at the time of formation of the third patch image G13 is the first correction candidate start timing. Furthermore, in the area A2 of the other end portion of the intermediate transfer belt 281 in the main scanning direction, the seventh patch image G22 formed in the seventh area part A22 has the highest toner concentration, and the start timing of the light emitting part LD4 at the time of formation of the seventh patch image G22 is the second correction candidate start timing.

When the drum peripheral surface 211 of the photosensitive drum 21 is scanned in the main scanning direction D1 by the light beams emitted by the light source 51, the photosensitive drum 21 is rotated around the drum rotation shaft extending in the main scanning direction D1. Therefore, even when the light beams scan the drum peripheral surface 211 in the main scanning direction D1, sub-scanning positions differ at both end portions in the axial direction of the drum rotation shaft of the photosensitive drum 21. As a consequence, there is a case in which the first correction candidate start timing and the second correction candidate start timing in the light emitting part LD4, which correspond to the areas A1 and A2 of both end portions of the intermediate transfer belt 281 in the main scanning direction, are different from each other. In this regard, in step S6 subsequent to step S5, the light emitting timing correction control part 915 determines whether the first correction candidate start timing and the second correction candidate start timing in the light emitting part LD4 are different from each other. When the first correction candidate start timing and the second correction candidate start timing in the light emitting part LD4 are not different from each other, that is, when it is determined that the first correction candidate start timing and the second correction candidate start timing are equal to each other, the light emitting timing correction control part 915 proceeds to step S7. On the other hand, when it is determined that the first correction candidate start timing and the second correction candidate start timing in the light emitting part LD4 are different from each other, the light emitting timing correction control part 915 proceeds to step S8.

In step S7, the light emitting timing correction control part 915 calculates correction candidate start timings of the light emitting part LD2 and the light emitting part LD3 in accordance with the main scanning pitch P1 on the basis of the first correction candidate start timing and the second correction candidate start timing which are equal to each other in the light emitting part LD4. The correction candidate start timings of the light emitting part LD2 and the light emitting part LD3 calculated as described above are timings shifted from the light emitting start timings of the light emitting part LD2 and the light emitting part LD3, which are stored in the storage part 911, in accordance with the position shift amounts for the installation positions of the light emitting part LD2 and the light emitting part LD3. When the correction candidate start timings of the light emitting part LD2 and the light emitting part LD3 are calculated in step S7, the light emitting timing correction control part 915 proceeds to step S10.

In step S8, the light emitting timing correction control part 915 calculates first and second correction candidate start timings of the light emitting part LD2 and first and second correction candidate start timings of the light emitting part LD3 on the basis of the first correction candidate start timing and the second correction candidate start timing which are different from each other in the light emitting part LD4. The first correction candidate start timings of the light emitting part LD2 and the light emitting part LD3 are calculated in accordance with the main scanning pitch P1 on the basis of the first correction candidate start timing of the light emitting part LD4, and corresponds to the area A1 of the one end portion of the intermediate transfer belt 281 in the main scanning direction. Furthermore, the second correction candidate start timings of the light emitting part LD2 and the light emitting part LD3 are calculated in accordance with the main scanning pitch P1 on the basis of the second correction candidate start timing of the light emitting part LD4, and corresponds to the area A2 of the other end portion of the intermediate transfer belt 281 in the main scanning direction.

When the first correction candidate start timing and the second correction candidate start timing in the light emitting part LD4, which correspond to the areas A1 and A2 of both end portions of the intermediate transfer belt 281 in the main scanning direction, are different from each other, the start timings of light emission by the light emitting parts LD2 to LD4 need to be changed for each scanning position of the drum peripheral surface 211 of the photosensitive drum 21 in the main scanning direction D1. In this regard, in step S9 subsequent to step S8, correction candidate start timings of the light emitting parts LD2 to LD4 for each scanning position in the main scanning direction D1 with respect to the photosensitive drum 21 are calculated by a partial equal magnification correction process on the basis of the first and second correction candidate start timings of the light emitting parts LD2 to LD4.

For example, when the first correction candidate start timings of the light emitting parts LD2 to LD4 are equal to the light emitting start timings of the light emitting parts LD2 to LD4 stored in the storage part 911 and the second correction candidate start timings of the light emitting parts LD2 to LD4 are timings earlier than the light emitting start timings and are timings on the assumption that the positions of the beams spots are shifted to the upstream side in the main scanning direction D1 by ¼ pixel, the following partial equal magnification correction process is performed.

The drum peripheral surface 211 of the photosensitive drum 21, for example, is divided into four areas in the main scanning direction D1. Among the four areas, for a first area of one end portion of the drum peripheral surface 211 in the main scanning direction, which corresponds to the area A1 of the one end portion of the intermediate transfer belt 281 in the main scanning direction, the correction candidate start timings of the light emitting parts LD2 to LD4 are set to be equal to the first correction candidate start timings. Furthermore, for a second area adjacent to a downstream side of the first area in the drum peripheral surface 211, the correction candidate start timings of the light emitting parts LD2 to LD4 are set as timings on the assumption that the positions of the beams spots are shifted to the upstream side in the main scanning direction D1 by 1/12 pixel (corresponding to ⅓ times of ¼ pixel). Furthermore, for a third area adjacent to a downstream side of the second area in the drum peripheral surface 211, the correction candidate start timings of the light emitting parts LD2 to LD4 are set as timings on the assumption that the positions of the beams spots are shifted to the upstream side in the main scanning direction D1 by ⅙ pixel (corresponding to ⅔ times of ¼ pixel). Furthermore, for a fourth area of the other end portion of the drum peripheral surface 211 in the main scanning direction, which corresponds to the area A2 of the other end portion of the intermediate transfer belt 281 in the main scanning direction, the correction candidate start timings of the light emitting parts LD2 to LD4 are set to be equal to the second correction candidate start timings.

The correction candidate start timings of the light emitting parts LD2 to LD4 calculated as described above are timings shifted from the light emitting start timings of the light emitting parts LD2 to LD4, which are stored in the storage part 911, in accordance with the position shift amounts for the installation positions of the light emitting parts LD2 to LD4. When the correction candidate start timings of the light emitting parts LD2 to LD4 are calculated in step S9, the light emitting timing correction control part 915 proceeds to step S10.

In step S10, the light emitting timing correction control part 915 recognizes the correction candidate start timings of the light emitting parts LD2 to LD4 calculated as described above as corrected new light emitting start timings, and allows the storage part 911 to store the new light emitting start timings. In the present embodiment, the control operation from step S5 to step F10 corresponds to third control which is performed by the light emitting timing correction control part 915 in the correction mode.

As described above, in the optical scanning device 23 of the present embodiment, in the correction mode for correcting the light emitting start timings stored in the storage part 911, the light emitting timing correction control part 915 of the optical scanning control section 91 performs the first control for allowing the positions of the beam spots of the light beams LB-1 and LB-4 emitted from the light emitting part LD1 (the reference light emitting part) and the light emitting part LD4 (the first remaining light emitting part) to be equal to each other, the second control for allowing the light emitting part LD4 to emit the light beam LB-4 at a plurality of different start timings and the patch images to be formed on the intermediate transfer belt 281, and the third control for correcting the light emitting start timings of the light emitting parts LD2 to LD4 on the basis of the start timing of the light emitting part LD4 at which the patch images has the highest toner concentration. In this way, when position shift occurs in the light emitting parts LD2 to LD4 with respect to the light emitting part LD1, the light emitting start timings of the light emitting parts LD2 to LD4 with respect to the light emitting part LD1 can be corrected with high accuracy.

Furthermore, the image forming apparatus 1 of the present embodiment includes the optical scanning device 23 capable of correcting the light emitting start timings of the light emitting parts LD2 to LD4 with high accuracy when position shift occurs in the light emitting parts LD2 to LD4 with respect to the light emitting part LD1. Therefore, when the position shift occurs in the light emitting parts LD2 to LD4, it is possible to scan each pixel constituting image data by light beams emitted from the light emitting parts LD2 to LD4 at the new light emitting start timings corrected with high accuracy. As a consequence, it is possible to maximally prevent position shift from occurring in pixels of an electrostatic latent image to be formed on the drum peripheral surface 211 of the photosensitive drum 21. Accordingly, pixel shift is prevented from occurring in a toner image to be transferred to the intermediate transfer belt 281, and pixel shift is also prevented from occurring in an image to be formed by the image forming apparatus 1 on the basis of the toner image. Thus, it is possible to form a high quality image.

As above, an example of the embodiment has been described; however, the technology of the present disclosure is not limited thereto and various types of modified embodiments can be employed.

(1) The aforementioned embodiment has described the configuration in which, in the correction mode, the light emitting timing correction control part 915 performs the first control for allowing the positions of the beam spots of the light beams LB-1 and Lb-4 from the light emitting part LD1 and the light emitting part LD4 on the drum peripheral surface 211 of the photosensitive drum 21 to be equal to each other by adjusting the rotation speed of the photosensitive drum 21; however, the technology of the present disclosure is not limited thereto. In the correction mode, the light emitting timing correction control part 915 may be configured to perform the first control for allowing the polygon mirror driving control part 913 to control the polygon mirror driving unit 62A, thereby adjusting the rotation speed of the polygon mirror 62. By adjusting the rotation speed of the polygon mirror 62, it is possible to allow the positions of the beam spots of the light beams LB-1 and Lb-4 from the light emitting part LD1 and the light emitting part LD4 on the drum peripheral surface 211 of the photosensitive drum 21 to be equal to each other.

(2) The aforementioned embodiment has described the configuration in which the light emitting parts LD1 to LD4 of the light source 51 are arranged with the main scanning pitch P1 and the sub-scanning pitch P2 in the predetermined arrangement direction D3. In this configuration, when the light emitting parts LD1 to LD4 emit light beams at the same light emitting start timing, the positions of the beam spots of the light beams LB-1 to LB-4 on the drum peripheral surface 211 of the photosensitive drum 21 are different from one another in the main scanning direction D1 in accordance with the main scanning pitch P1 and are different from one another in the sub-scanning direction D2 in accordance with the sub-scanning pitch P2. Therefore, when the light emitting start timings of the light emitting parts LD2 to LD4 with respect to the light emitting part LD1 are corrected, the light emitting timing correction control part 915 needs to perform the first control for allowing the positions of the beam spots of the light beams LB-1 and Lb-4 from the light emitting part LD1 and the light emitting part LD4 on the drum peripheral surface 211 of the photosensitive drum 21 to be equal to each other.

In contrast, the scanning scheme of the light beams LB-1 to LB-4 emitted from the light emitting parts LD1 to LD4 of the light source 51 may be set as a multiple exposure scanning scheme in advance. The optical scanning device 23 employing the multiple exposure scanning scheme is configured such that the positions of the beam spots of the light beams LB-1 to LB-on the drum peripheral surface 211 of the photosensitive drum 21 are equal to one another. In the case of the multiple exposure scanning scheme, in the correction mode, the light emitting timing correction control part 915 does not perform the first control for allowing the positions of the beam spots of the light beams LB-1 and Lb-4 on the drum peripheral surface 211 of the photosensitive drum 21 to be equal to each other. Therefore, it is possible to shorten a time required for the correction control operation for correcting the light emitting start timings of the light emitting parts LD2 to LD4 with respect to the light emitting part LD1 in the correction mode.

What is claimed is:

1. An optical scanning device, which is installed at an image forming apparatus including an image carrying member having a peripheral surface carrying an electrostatic latent image and a developer image and a transfer body, to which the developer image on the peripheral surface is transferred, and scans the peripheral surface with a light beam in a main scanning direction to form the electrostatic latent image on the peripheral surface, comprising:

a light source in which a plurality of light emitting parts for emitting light beams are arranged with a prescribed main scanning pitch in a predetermined arrangement direction;

a storage part that stores light emitting start timings of remaining light emitting parts, except for a reference light emitting part being one of the plurality of light emitting parts, with respect to the reference light emitting part, the light emitting start timings being set in accordance with the main scanning pitch;

a control unit that performs a correction mode which is a mode for correcting the light emitting start timings stored in the storage part and allows an electrostatic latent image to be formed on the peripheral surface in order to form a developer image with a specific pattern on the transfer body, the electrostatic latent image corresponding to the developer image with a specific pattern; and a concentration detection unit that is arranged to face the transfer body and detects developer concentration of the developer image with a specific pattern formed on the transfer body, wherein in the correction mode the control unit performs first control for allowing positions of beam spots of light beams, which are emitted from the reference light emitting part and one first remaining light emitting part of the remaining light emitting parts, on the peripheral surface to be equal to each other, second control for allowing the reference light emitting part to emit the light beam, allowing the first remaining light emitting part to emit the light beam at a plurality of different start timings on a basis of the light emitting start timing stored in the storage part and corresponding to the first remaining light emitting part, allowing an electrostatic latent image to be formed on the peripheral surface, and allowing the developer image with a specific pattern corresponding to the electrostatic latent image to be formed in different area parts on the transfer body in correspondence to the start timings, and third control for recognizing a start timing of the first remaining light emitting part at which the developer concentration of the developer image with a specific pattern formed in the each area part on the transfer body is highest, and correcting the light emitting start timings of the remaining light emitting parts in accordance with the main scanning pitch on a basis of the recognized start timing, the developer concentration being detected by the concentration detection unit.

2. The optical scanning device of claim 1, wherein among the plurality of light emitting parts, the reference light emitting part is a light emitting part arranged at one end in the arrangement direction, and the first remaining light emitting part is a light emitting part arranged at a remaining end opposite to the one end in the arrangement direction.

3. The optical scanning device of claim 1, wherein in the correction mode, the control unit performs the first control by adjusting a rotation speed of the image carrying member.

4. The optical scanning device of claim 1, further comprising:

a deflector that reflects the light beams emitted from the plurality of light emitting parts and deflects and scans the reflected light beams while rotating around a shaft, wherein in the correction mode, the control unit performs the first control by adjusting a rotation speed of the deflector.

5. The optical scanning device of claim 1, wherein a scanning scheme of the light beams emitted from the plurality of light emitting parts is set in advance as a multiple exposure scanning scheme in which positions of beam spots of the light beams on the peripheral surface are equal to each other, and in the correction mode, the control unit performs the second control and the third control without performing the first control.

6. An image forming apparatus comprising:

an image carrying member;

the optical scanning device of claim 1, which scans the peripheral surface of the image carrying member with the light beam, thereby allowing the electrostatic latent image to be carried on the peripheral surface;

a development part that supplies a developer to the peripheral surface on which the electrostatic latent image is formed and allows the developer image to be carried on the peripheral surface; and a transfer body to which the developer image on the peripheral surface is transferred.

* * * * *